US006137383A

United States Patent [19]

De Lillo

[11] Patent Number: 6,137,383

[45] Date of Patent: Oct. 24, 2000

[54] MULTILAYER DIELECTRIC EVANESCENT MODE WAVEGUIDE FILTER UTILIZING VIA HOLES

[75] Inventor: Rocco A. De Lillo, New Rochelle, N.Y.

[73] Assignee: Merrimac Industries, Inc., West Caldwell, N.J.

[21] Appl. No.: 09/330,899

[22] Filed: Jun. 11, 1999

Related U.S. Application Data

[63] Continuation-in-part of application No. 09/199,831, Nov. 25, 1998.

[60] Provisional application No. 60/098,069, Aug. 27, 1998.

[51] Int. Cl.[7] ..... H01P 1/219

[52] U.S. Cl. ..... 333/210; 333/203; 333/208

[58] Field of Search ..... 333/203, 208, 333/210, 212, 227, 230

[56] References Cited

U.S. PATENT DOCUMENTS

| | | | |
|---|---|---|---|
| 3,949,327 | 4/1976 | Chapell | 333/208 X |
| 3,955,161 | 5/1976 | MacTurk | 333/208 X |
| 4,646,039 | 2/1987 | Saad | 333/210 |
| 4,837,535 | 6/1989 | Konishi et al. | 333/210 |
| 4,980,662 | 12/1990 | Simon et al. | 333/134 |
| 5,382,931 | 1/1995 | Piloto et al. | 333/208 |
| 5,406,234 | 4/1995 | Willems | 333/203 |
| 5,739,734 | 4/1998 | Chen et al. | 333/210 |
| 6,002,306 | 12/1999 | Arakawa | 333/134 |
| 6,002,307 | 12/1999 | Arawaka | 333/135 |

FOREIGN PATENT DOCUMENTS

| | | | |
|---|---|---|---|
| 59-86307 | 5/1984 | Japan . | |
| 63-220603 | 9/1988 | Japan | 333/208 |

OTHER PUBLICATIONS

Konishi, Yoshihiro; "Novel Dielectric Waveguide Components–Microwave Applications of New Ceramic Materials"; *Proceedings of the IEEEl*, vol. 79, No. 6 Jun. 1991; pp726–740. .

George F. Craven and C. K. Mok, "The Design of Evanescent Mode Waveguide Bandpass Filters for a Prescribed Insertion Loss Characteristic," *IEEE Transactions on Microwave Theory and Techniques*, vol. MTT–19, No. 3, Mar. 1971, pp. 295–308.

Richard V. Snyder, "New Application of Evanescent Mode Waveguide to Filter Design," *IEEE Transactions on Microwave Theory and Techniques*, vol. MTT–25, No. 12, Dec. 1977, pp. 1013–1021.

D. Willems and E. Griffin, "Evanescent–Mode Waveguide Filters Built In A Day," *Microwaves & RF*, vol. 26, No. 7, Jul. 1987, pp. 117–124.

Sarjit S. Bharj, "Evanescent Mode Waveguide to Microstrip Transition," *Microwave Journal*, International Edition, vol. 26, No. 2, Feb. 1983, p. 147.

Peter A. Rizzi, *Microwave Engineering: Passive Circuits*, Prentice Hall, Englewood Cliffs, New Jersey, 1988, pp. 200–219.

*Primary Examiner*—Robert Pascal
*Assistant Examiner*—Barbara Summons
*Attorney, Agent, or Firm*—Chadbourne & Parke LLP; Drew M. Wintringham; Francis G. Montgomery

[57] ABSTRACT

A multilayer dielectric evanescent mode waveguide bandpass filter with resonators utilizing via hole technology is capable of achieving very narrow bandwidths with minimal insertion loss and high selectivity at microwave frequencies is provided. The resonators may also be used as feed posts. A typical implementation of this filter is fabricated with soft substrate multilayer dielectrics with high dielectric constant ceramics. This filter typically takes up less space than other filters presently available. A typical implementation operates at a center frequency of 1 GHz, although other center frequencies, such as approximately 0.5 GHz to approximately 60 GHz, are achievable. The perimeter of the filter may be defined by via holes or plated slots.

20 Claims, 17 Drawing Sheets

MULTILAYER DIELECTRIC EVANESCENT MODE WAVEGUIDE FILTER UTILIZING VIA HOLES

PATENT APPLICATION

This application is a continuation-in-part of U.S. patent application Ser. No. 09/199,831 filed on Nov. 25, 1998, which claims priority from U.S. Provisional Patent Application No. 60/098,069, filed on Aug. 27, 1998.

FIELD OF THE INVENTION

This invention relates to evanescent mode waveguide bandpass filters. More particularly, this invention discloses the topology of a filter that typically operates at microwave frequencies and utilizes via hole technology for resonators to achieve very narrow bandwidths with minimal insertion loss and high selectivity.

BACKGROUND OF THE INVENTION

Over the decades, wireless communication systems have become more and more technologically advanced, with performance increasing in terms of smaller size, operation at higher frequencies and the accompanying increase in bandwidth, lower power consumption for a given power output, and robustness, among other factors. The trend toward better communication systems puts ever-greater demands on the manufacturers of these systems.

Today, the demands of satellite, military, and other cutting-edge digital communication systems are being met with microwave technology, which typically operates at frequencies from approximately 500 MHz to approximately 60 GHz or higher. Many of these systems use bandpass filters to reduce noise or other unwanted frequencies that may be present in microwave signals.

One popular filter used for narrow bandwidth applications is the SAW (surface acoustic wave) filter, which is typically used for applications involving frequencies from the VHF through L bands. SAW filters have the disadvantage of being electrostatic sensitive, and at higher frequencies they have the disadvantage of being lossy. For example, due to coupling inefficiencies, resistive losses, and impedance mismatches, SAW filters become prohibitively lossy at frequencies above approximately 0.8 GHz. At even higher frequencies, such as a few GHz, SAW filters are bounded by sub-micron electrode geometries.

Another typical implementation of bandpass filters uses evanescent mode waveguides. An evanescent mode waveguide may have a conducting tube having an arbitrary cross-sectional shape and having at least one resonator. The dimensions of the cross-section are chosen to allow wave propagation at the operating frequency of interest while causing other frequencies to rapidly decay. A sectional length of an evanescent mode waveguide can be represented as a pi or tee section of inductors whose values are functions of section length, dielectric constant, and guide cross section. A resonant post may be inserted in such a way that it penetrates the broad wall of the evanescent mode waveguide, thereby forming a shunt capacitive element between opposite conducting walls of the guide. The resulting combination of shunt inductance and shunt capacitance forms a resonance. By placing multiple resonator posts spaced at varying distances along a waveguide, multiple resonances are introduced resulting in a wide variety of bandpass functions. The resulting filter is a microwave equivalent of a lumped inductive and capacitive bandpass filter.

Currently existing evanescent mode waveguides are relatively large in size and weight, especially as the center frequency of operation decreases. This limitation exists since the cross-sectional waveguide dimensions necessary to achieve both the high unloaded quality factor (Q) of resonators and the amount of realizable loading capacitance increases as the filter center frequency decreases. Unloaded Q is inversely proportional to the amount of insertion loss and to the bandwidth of the filter. Therefore, for low loss filters with high selectivity, high unloaded resonator Q is desirable, resulting in the need for a physically large waveguide to maintain performance as the center frequency decreases.

Tuning screws are typically used to form the resonator posts in waveguides. The gaps between the end face of a tuning screw and the wall of the waveguide form shunt capacitances. In air dielectric waveguides, there is a physical limitation to the amount of realizable shunt capacitance that may be achieved, since the physical diameter of the screw must be kept small enough not to perturb the modal performance of the waveguide. By way of example, narrow band filters utilizing tuning screws are expensive to manufacture or difficult to tune because of the necessarily small physical tolerances involved, such as the fineness of the thread of the screw. Another limitation is the allowable physical proximity between a tuning screw's end face and the waveguide wall. It is difficult and expensive to manufacture a tuning screw mechanism that will properly function as a resonator post for a physical proximity that is under one mil (thousandth of an inch), due to the precision required. On the other hand, dielectric filled waveguides, which can increase both unloaded resonator Q and loading capacitance, are not usually employed because it is physically difficult to manufacture and tune them.

Furthermore, waveguide filters utilizing tuning screws are usually manufactured as discrete units that cannot share space on a multilayer substrate structure with other components. Thus, a microwave circuit would not have an embedded waveguide filter, but rather be connected to a discrete waveguide filter that is separately manufactured. The manufacture and subsequent connection of discrete components results in an increase in the costs, size, weight, and robustness of the final product.

SUMMARY OF THE INVENTION

The present invention relates to a multilayer dielectric evanescent mode waveguide bandpass filter that is capable of achieving very narrow bandwidths with minimal insertion loss and high selectivity at microwave frequencies. A typical implementation of this filter is fabricated with soft substrate multilayer dielectrics with high dielectric constant ceramics and via hole technology.

It is an object of this invention to provide an evanescent mode waveguide bandpass filter that is easy to manufacture using multilayer technology.

It is another object of this invention to provide an evanescent mode waveguide bandpass filter that has smaller cross sectional dimensions than traditional microwave bandpass filters while maintaining an equivalent unloaded Q for resonators.

It is another object of this invention to provide an evanescent mode waveguide bandpass filter that has a lower cutoff frequency and increased unloaded Q compared to traditional air-filled guides having an equivalent cross-section.

It is another object of this invention to provide an evanescent mode waveguide bandpass filter to eliminate electrical and mechanical constraints typically found with conventional waveguide structures.

It is another object of this invention to provide an evanescent mode waveguide bandpass filter that may be manufactured using multilayer technology so as to be directly integratable with other multilayer devices.

It is another object of this invention to provide an evanescent mode waveguide bandpass filter that can be manufactured over a broad frequency range of operation.

It is another object of this invention to provide an evanescent mode waveguide bandpass filter that has superior power-handling capabilities over other existing filters.

It is another object of this invention to provide an evanescent mode waveguide bandpass filter that is small in size and not electrostatic sensitive.

It is another object of this invention to provide an evanescent mode waveguide bandpass filter that is temperature stable.

It is another object of this invention to provide an evanescent mode waveguide bandpass filter that eliminates the need for tuning screws by providing high dielectric ceramics embedded within lower dielectric constant material to form capacitors having capacitance values much larger than those realizable with tuning screws.

It is another object of this invention to provide an evanescent mode waveguide bandpass filter that utilizes electroplating technology to allow the conductive walls of the waveguide to be formed around filler dielectric material.

It is another object of this invention to provide an evanescent mode waveguide bandpass filter that utilizes via hole technology to define the perimeter of the filter.

It is another object of this invention to provide an evanescent mode waveguide bandpass filter that utilizes slots to define the perimeter of the filter.

It is another object of this invention to provide an evanescent mode waveguide bandpass filter that utilizes via holes as feed posts.

BRIEF DESCRIPTION OF THE DRAWINGS

Some of the following figures depict circuit patterns, including copper etchings and holes, on substrate layers. Although certain structures, such as holes, may be enlarged in the figures to show clarity, these figures are drawn to be accurate as to the shape and relative placement of the various structures for a preferred embodiment of the invention.

DETAILED DESCRIPTION OF THE INVENTION

Operation of the Invention

Figure 1A:
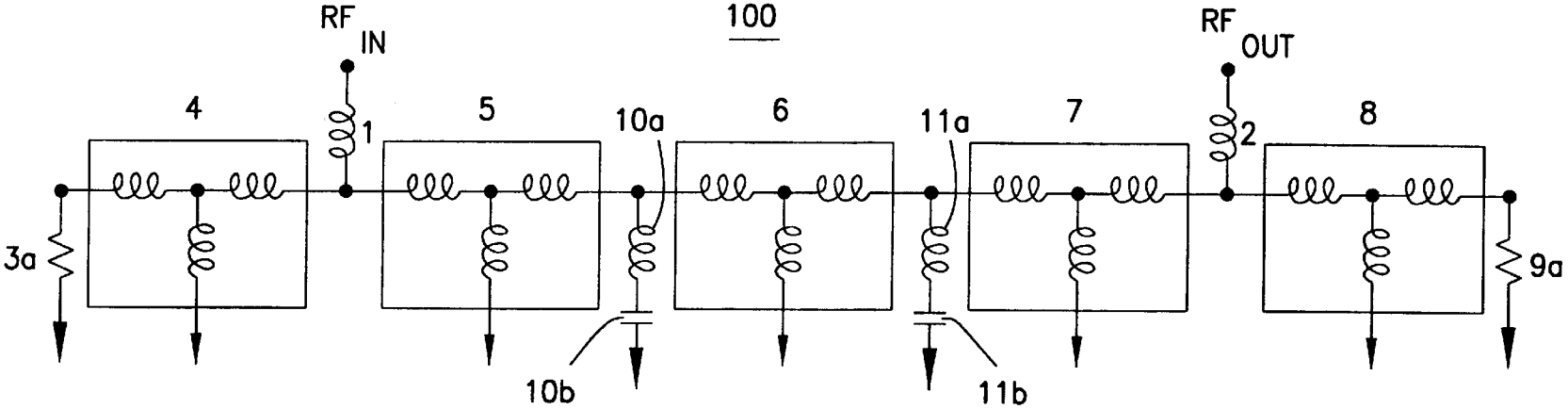
FIG. 1*a* is a schematic diagram of a preferred embodiment of an evanescent mode waveguide filter wherein sections of the filter are modeled using tee networks of inductors.
Figure 1B:
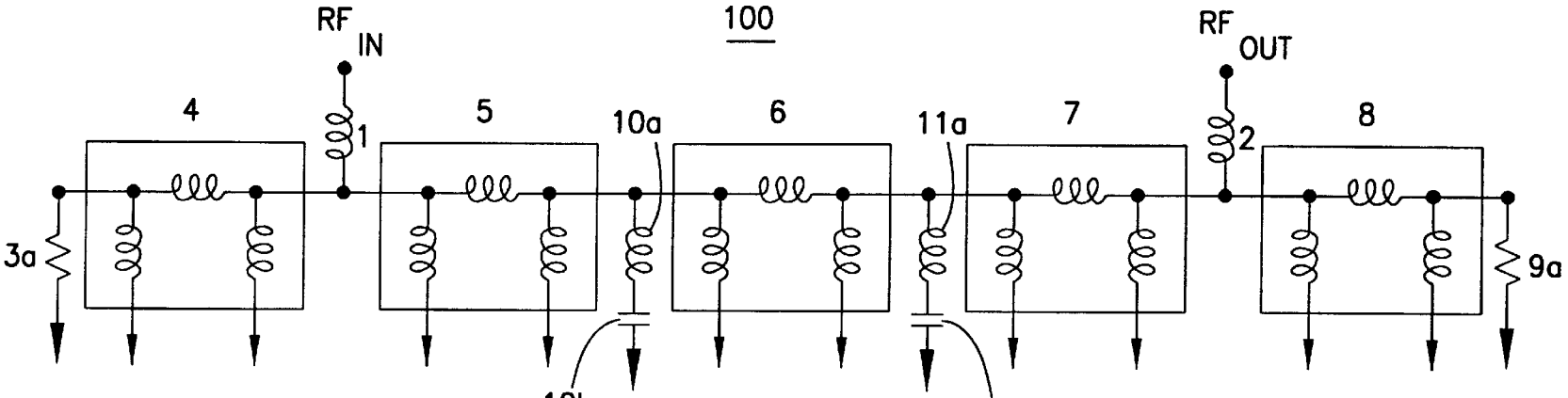
FIG. 1*b* is a schematic diagram of the evanescent mode waveguide filter shown in FIG. 1*a* wherein sections of the filter are modeled using pi networks of inductors.
Figure 2:
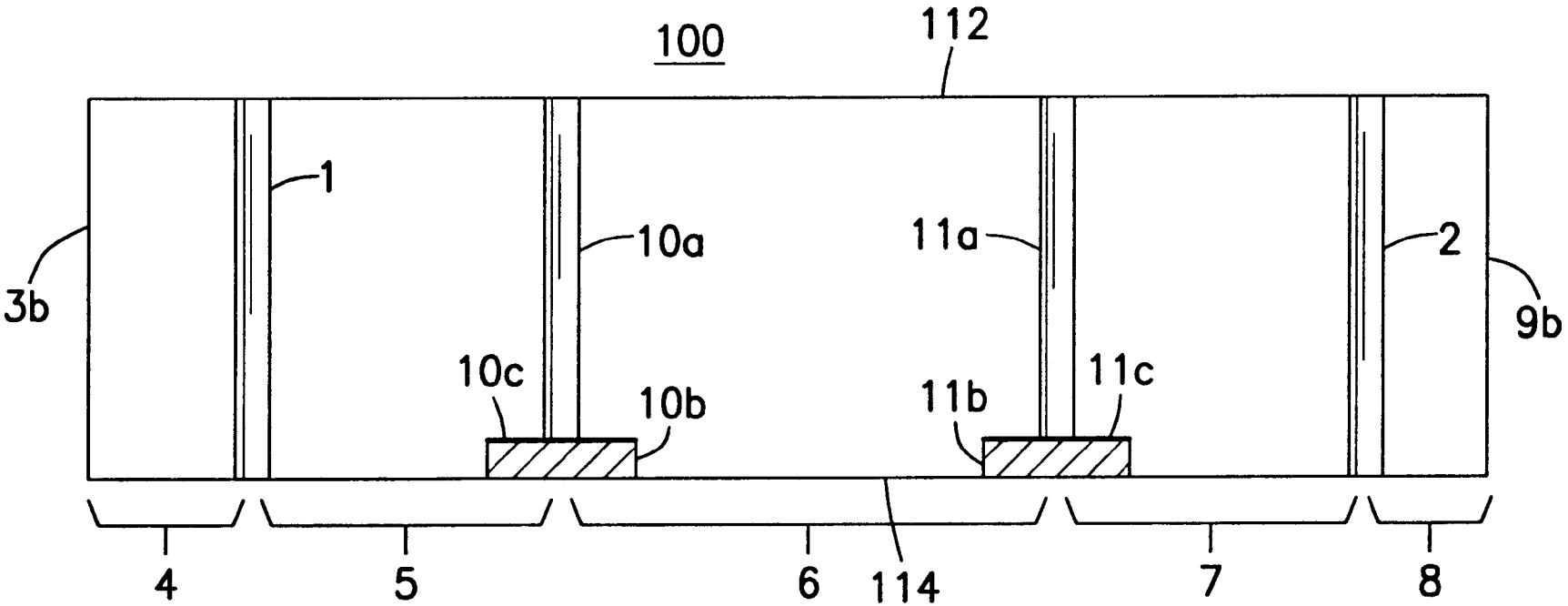
FIG. 2 is an assembly diagram of the evanescent mode waveguide filter shown in FIG. 1*a* and FIG. 1*b*.
Figure 3A:
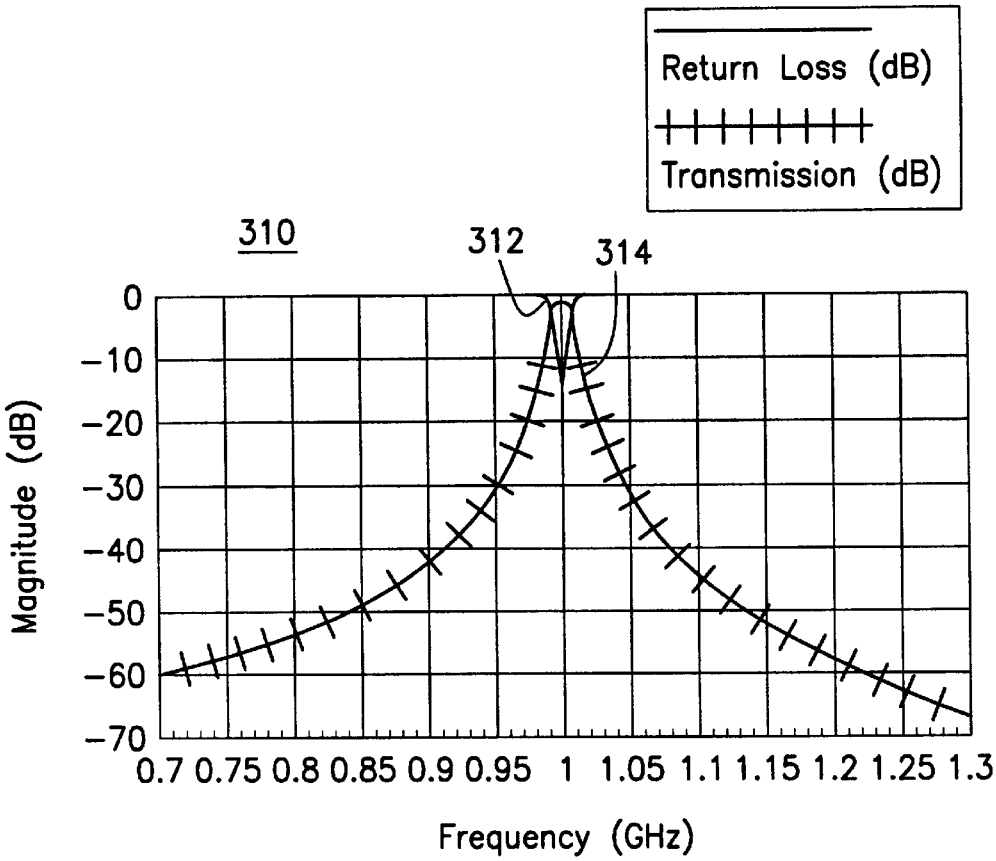
FIG. 3*a* shows a performance curve portraying return loss vs. frequency for a preferred embodiment of an evanescent mode waveguide filter having a functional bandwidth of 0.9%.
Figure 3B:
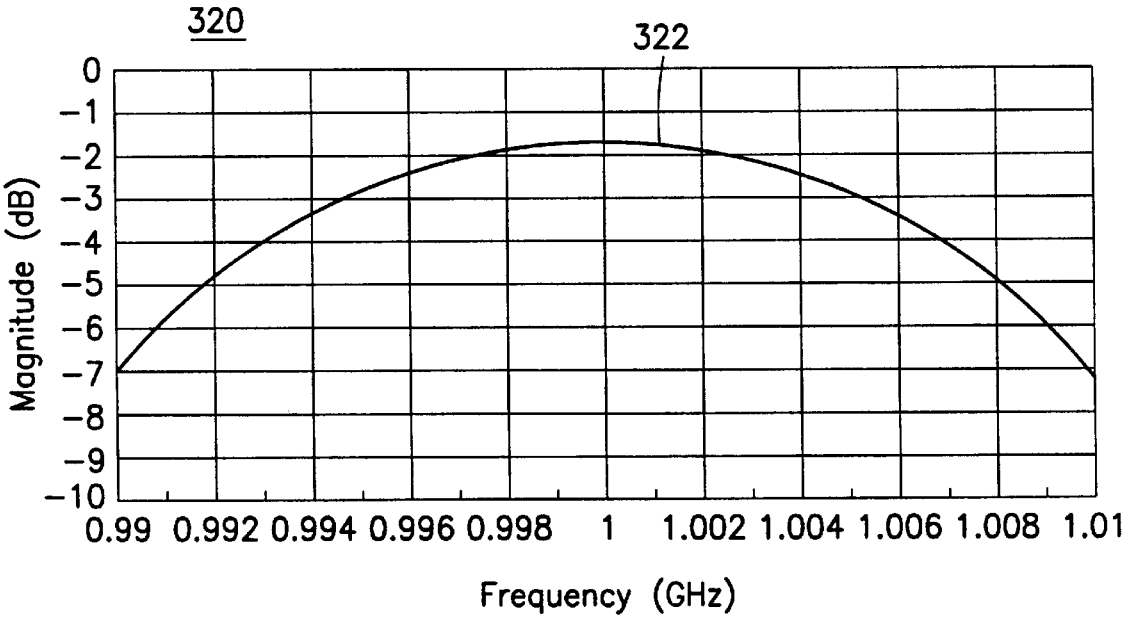
FIG. 3*b* shows a performance curve portraying transmission vs. frequency for a preferred embodiment of an evanescent mode waveguide filter having a functional bandwidth of 0.9%.
Figure 3C:
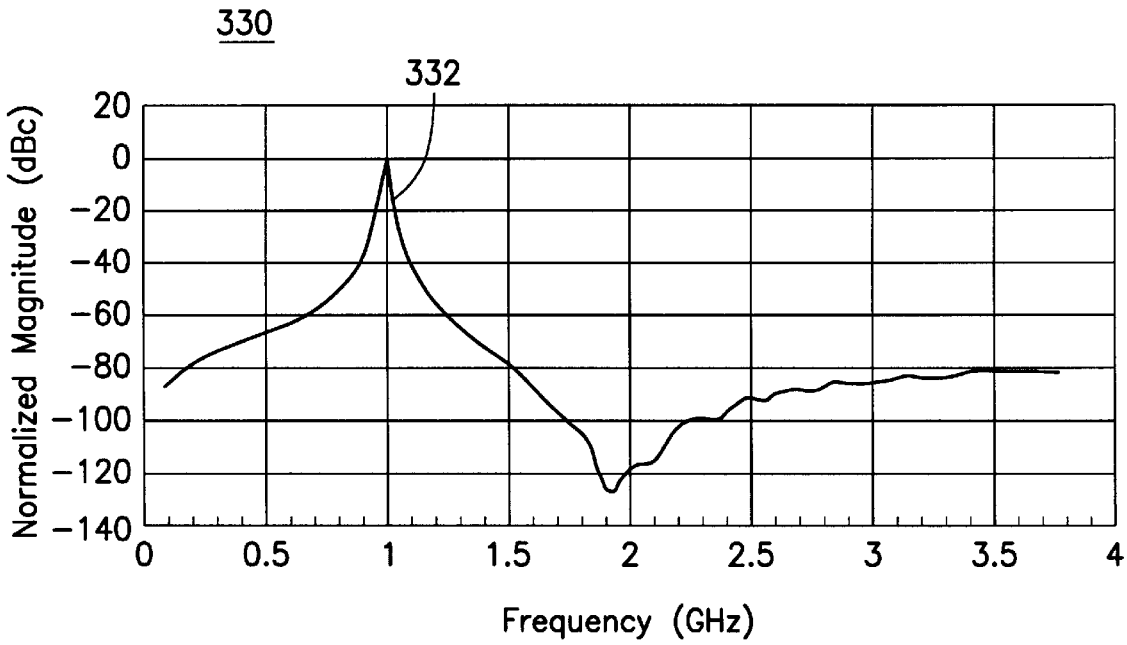
FIG. 3*c* shows a performance curve portraying normalized magnitude vs. frequency for a preferred embodiment of an evanescent mode waveguide filter having a functional bandwidth of 0.9%.
Figure 3D:
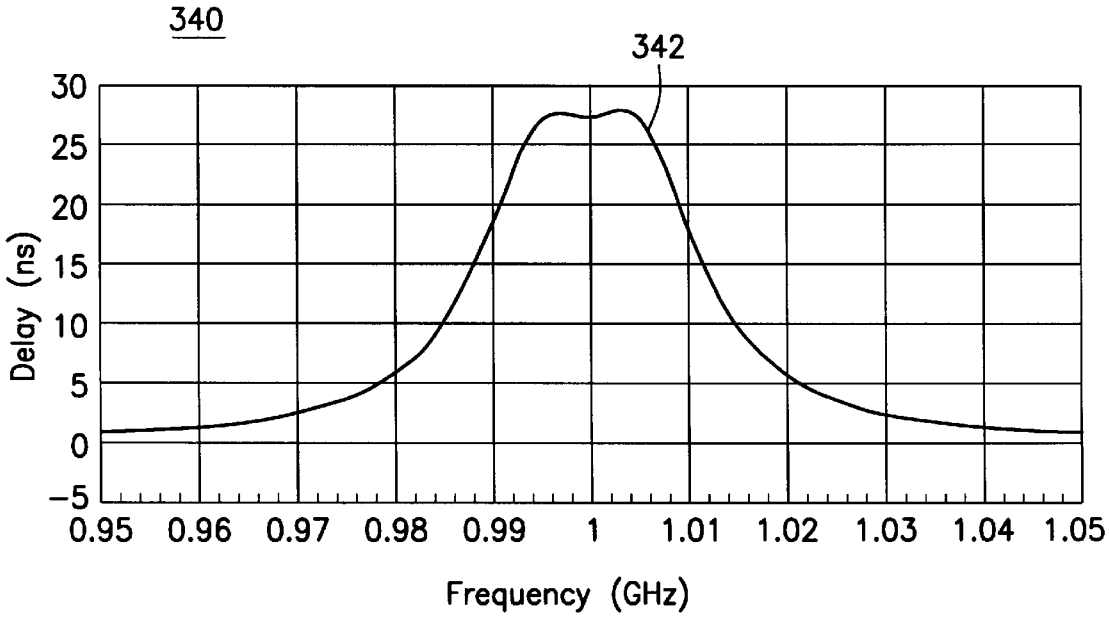
FIG. 3*d* shows a performance curve portraying group delay vs. frequency for a preferred embodiment of an evanescent mode waveguide filter having a functional bandwidth of 0.9%.
Figure 4A:
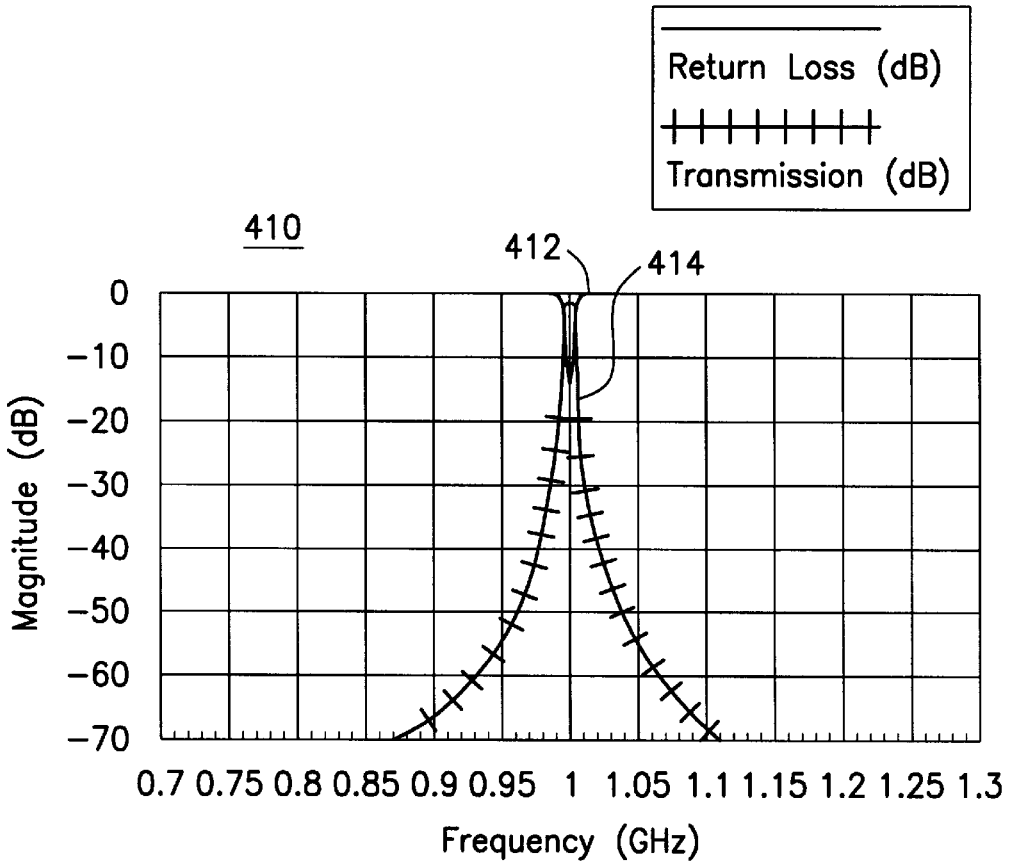
FIG. 4*a* shows a performance curve portraying return loss vs. frequency for a preferred embodiment of an evanescent mode waveguide filter having a functional bandwidth of 0.3%.
Figure 4B:
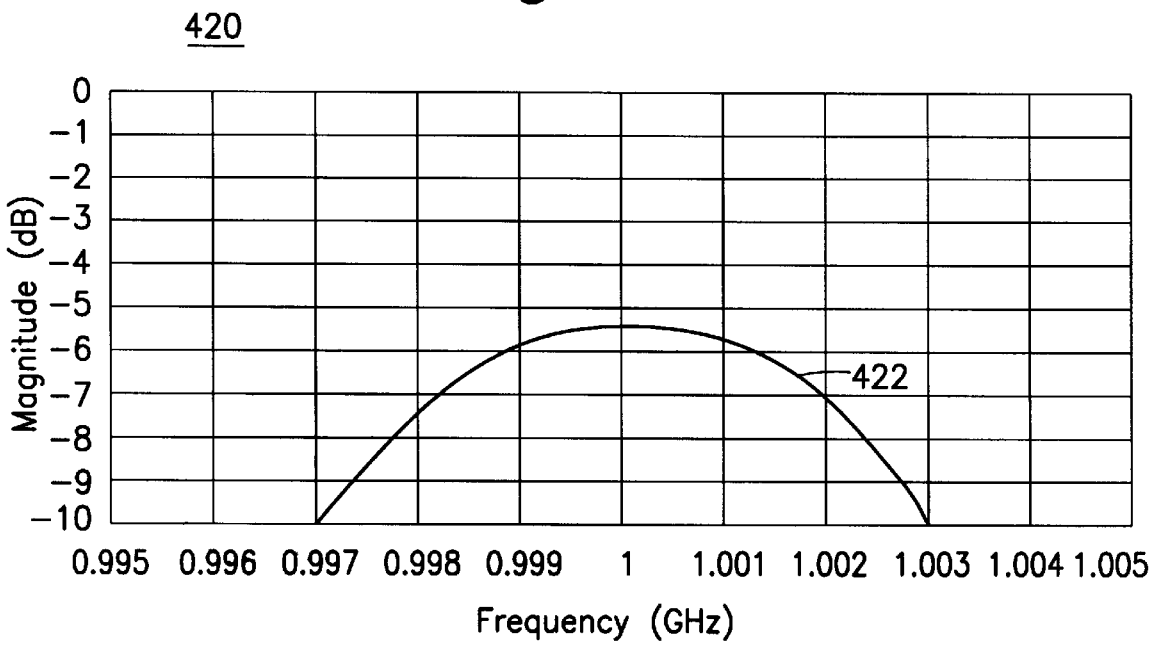
FIG. 4*b* shows a performance curve portraying transmission vs. frequency for a preferred embodiment of an evanescent mode waveguide filter having a functional bandwidth of 0.3%.
Figure 4C:
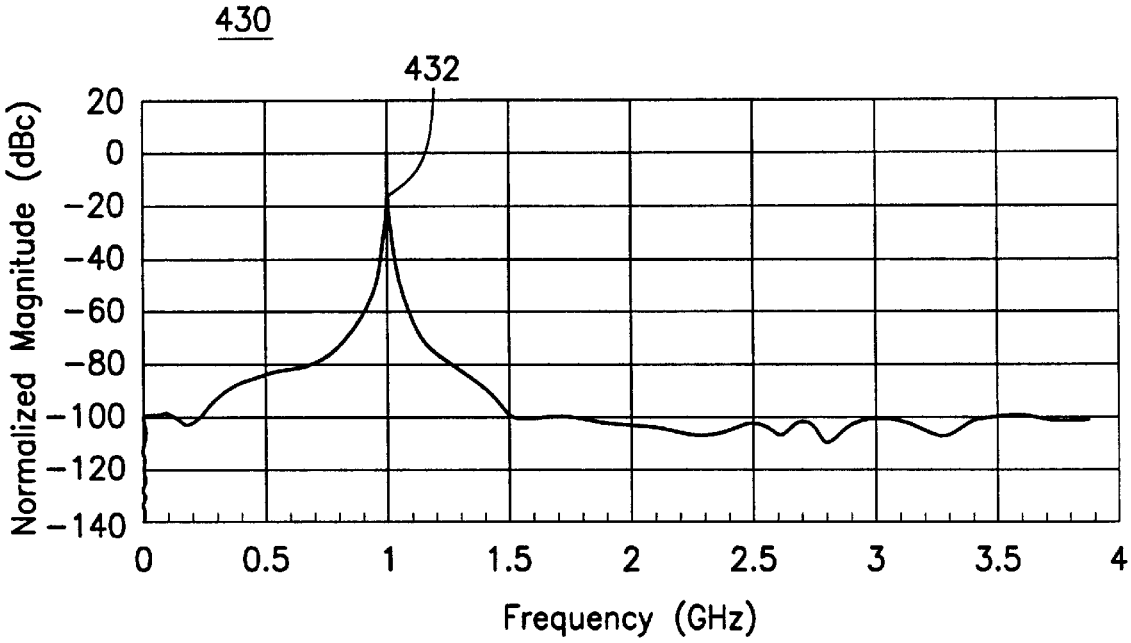
FIG. 4*c* shows a performance curve portraying normalized magnitude vs. frequency for a preferred embodiment of an evanescent mode waveguide filter having a functional bandwidth of 0.3%.
Figure 4D:
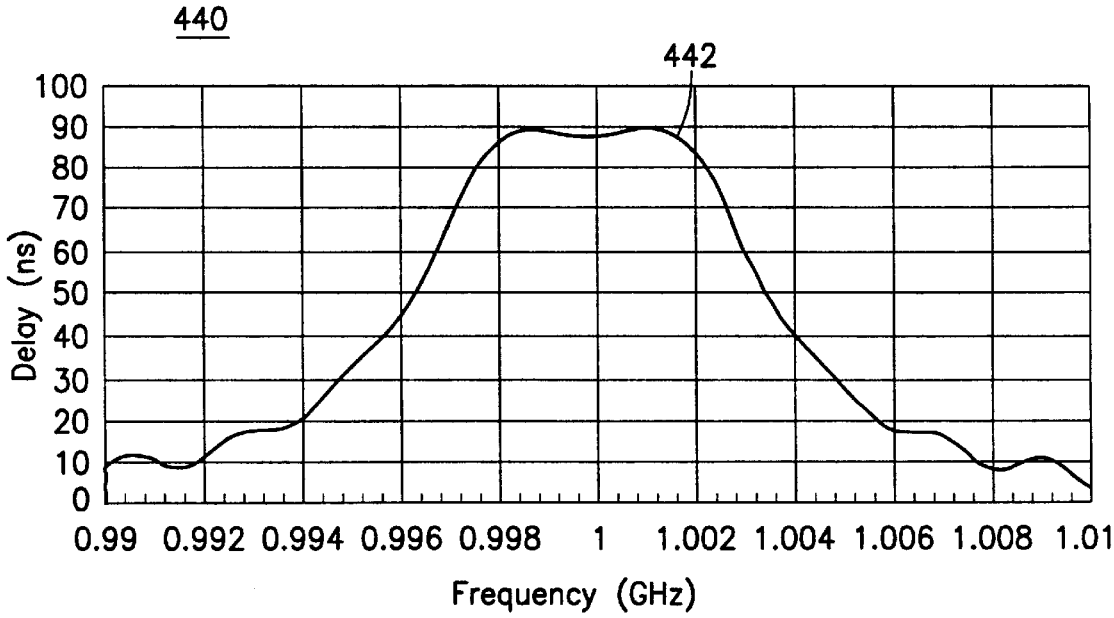
FIG. 4*d* shows a performance curve portraying group delay vs. frequency for a preferred embodiment of an evanescent mode waveguide filter having a functional bandwidth of 0.3%.
Figure 11A:
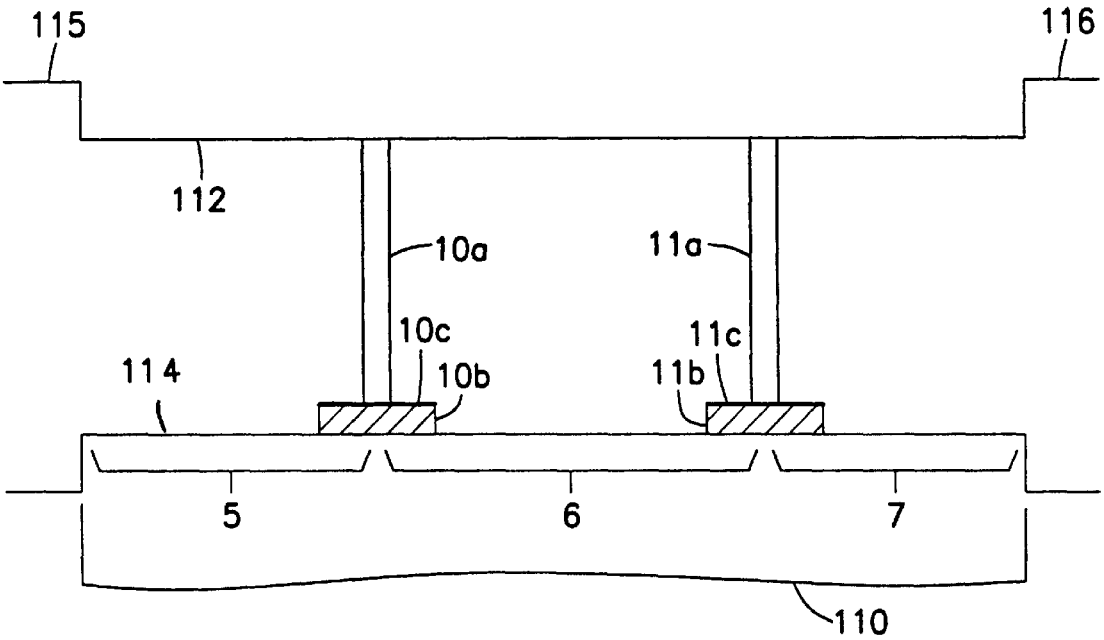
FIG. 11*a* is an assembly diagram of an open evanescent mode waveguide filter.

Referring to FIGS. 1*a* and 1*b*, schematic diagrams of a preferred embodiment of a second order (n=2) evanescent mode waveguide bandpass filter 100, not taking dielectric losses into account, is shown. FIGS. 1*a* and 1*b* are different representations of the same evanescent mode waveguide bandpass filter 100, and it is obvious to those of ordinary skill in the art of analog circuit design that the tee networks of inductors representing waveguide sections 4, 5, 6, 7, 8 may be easily transformed into pi networks of inductors. An assembly diagram of filter 100 is shown in FIG. 2. In a preferred embodiment, a signal is inductively fed from an input TEM transmission line to feed post 1, which is preferably a via hole, thereby exciting the dominant $TE_{10}$ evanescent mode of waveguide bandpass filter 100. Waveguide sections 4, 5, 6, 7, 8 of waveguide bandpass filter 100 form inductive tee or pi sections and constitute filter elements. In a preferred embodiment, wherein waveguide bandpass filter 100 is short-circuited, resistances 3*a*, 9*a* model the sheet resistivity of end conductive walls 3*b*, 9*b* (in an alternative preferred embodiment an open-ended waveguide, such waveguide bandpass filter 110 in FIGS. 11*a* and 11*b*, does not have end shielding). Resonator via holes 10*a*, 11*a* are inserted in waveguide bandpass filter 100 such that capacitors 10*b*, 11*b* form resonances with inductive sections 5, 6, 7 to achieve the desired shape factor. The desired shape factor is dependent upon the desired filter performance characteristics, and is typically defined as the ratio of the 60 dB bandwidth to the 6 dB bandwidth. Feed post 2, which is preferably a via hole, transfers the signal to an output TEM transmission line.

Physical Construction of the Invention

In a preferred embodiment waveguide bandpass filter 100 is fabricated in a multilayer structure comprising soft substrate PTFE laminates having typical permittivities ranging from approximately 1 to approximately 100, although such laminates are typically commercially available with permittivities ranging from approximately 3 to approximately 10. A process for constructing such a multilayer structure is disclosed by U.S. Provisional Patent Application No. 60/074,571, entitled "Method of Making Microwave, Multifunction Modules Using Flouropolymer Composite Substrates", filed Feb. 13, 1998, and U.S. Pat. Application No. 09/199,675 of the same title, filed Nov. 25, 1998, both incorporated herein by reference.

In a preferred embodiment, feed posts 1, 2 extend from a TEM line feed from conductive wall 112 to conductive wall 114 of waveguide bandpass filter 100, or in an alternative preferred embodiment, a loop-type feed structure is used and feed post 1 extends from conductive wall 3*b* to conductive wall 112 or conductive wall 114 and feed post 2 extends from conductive wall 9*b* to conductive wall 112 or conductive wall 114. Waveguide bandpass filter 100 is short-circuited at conductive walls 3*b*, 9*b*. The input and output feed lines (not shown) can be, for example, coaxial or printed strips for surface mounting. Resonator via holes 10*a*, 11*a* extend from top conducting wall 112 of waveguide bandpass filter 100 and are terminated by the top electrodes 10*c*, 11*c*, of capacitors 10*b*, 11*b*, respectively. Capacitors 10*b*, 11*b* are short-circuited to bottom conducting wall 114 of waveguide 110. Resonator via holes 10*a*, 11*a* are fabricated with high aspect ratios, which are 5:1 in a preferred embodiment.

Conductive walls 3*b*, 9*b*, 112, 114, as well as the conductive side walls extending from the long edges of conductive wall 112 to the long edges of conductive wall 114, are formed by electroplating the total surface area of waveguide bandpass filter 100, although in an alternative preferred embodiment some of the walls, top conducting wall 112 and bottom conducting wall 114 by way of example, comprise conducting material that does not require electroplating.

In a preferred embodiment, the waveguide bandpass filter 100 contains multilayer dielectric material. In an alternative preferred embodiment, material inside waveguide bandpass filter 100 is substantially removed and replaced with air or another gas to act as the loading material.

The various dimensions for waveguide bandpass filter 100 are calculated from formulas found in Craven and Mok, "The Design of Evanescent Mode Waveguide Bandpass Filters for a Prescribed Insertion Loss Characteristic", *IEEE Trans. Microwave Theory and Techniques*, MTT-19, No. 3, 3/71 pp. 295–308, incorporated herein by reference, and modified for dielectric-loaded waveguides. More general formulas for dielectric-loaded waveguides are found in Rizzi, P. A., *Microwave Engineering*, Prentice Hall, 1988, at section 5-4, incorporated herein by reference. In a preferred embodiment, cross-sectional dimensions are calculated for a prescribed value of unloaded resonator Q. The cross-sectional dimensions may be modified to conform with other desired shapes, such as, by way of example only, double ridged waveguides. Resonator spacings are calculated using modified formulations for evanescent mode section length as a function of inductance.

Although a desired filter may be constructed in different ways and/or having higher orders, the following calculations were used to design a simple second order filter. To simplify the calculations involved and to create substantially symmetrical bandpass filters, waveguide bandpass filter 100 is designed to be physically symmetrical (for example, in this preferred embodiment capacitors 10*b*, 11*b* have the same dielectric constant and same capacitance, although in an alternative preferred embodiment capacitors 10*b*, 11*b* have unique dielectric constants and different capacitances).

A pi or tee network of inductors may be used to model a length of waveguide bandpass filter 100. For example, for a pi network as shown in FIG. 1*b*, the inductance values are:

$$L_{series}=X\sinh(\gamma l)$$

and $$L_{shunt}=\frac{X}{\tanh\left(\frac{\gamma l}{2}\right)}$$

A pi network of inductors may easily be transformed into a tee network of inductors. The following formulas apply to a model based on a tee network, as shown in FIG. 1*a*. For a tee network of inductors, the inductance values are:

$$L_{series}=X\tanh\left(\frac{\gamma l}{2}\right)$$

and $$L_{shunt}=\frac{X}{\sinh(\gamma l)}$$

where l is the length of the inductor section and the complex propagation constant of waveguide bandpass filter 100 is:

$$\gamma=\frac{2\pi}{\lambda}\sqrt{\left(\frac{f_c}{f}\right)^2-1}$$

$$\lambda=\frac{c}{f\sqrt{\varepsilon_r}}$$

$$f_c=\frac{c}{2a\sqrt{\varepsilon_r}}$$

$$X=\frac{120\pi b}{a\sqrt{\varepsilon_r}\sqrt{\left(\frac{f_c}{f}\right)^2-1}}$$

-continued $a$ = width of waveguide $b$ = height of waveguide $c$ = the speed of light $\varepsilon_r$ = dielectric constant of waveguide $f_c$ = cutoff frequency of waveguide In an alternative preferred embodiment, gas is used as the loading material, in which case $$\lambda=\frac{c}{f\sqrt{\varepsilon_r\mu_r}}$$

$$f_c=\frac{c}{2a\sqrt{\varepsilon_r\mu_r}}$$

$$X=\frac{120\pi b}{a\sqrt{\varepsilon_r\mu_r}\sqrt{\left(\frac{f_c}{f}\right)^2-1}}$$

$\mu_r$=relative permeability of the medium

The length of section 6 (which is the distance between the center of resonator via hole 10*a* and the center of resonator via hole 11*a*) is initially chosen such that:

$$l=\frac{1}{\gamma}\cosh^{-1}\left(\frac{\Delta}{bw}\right)$$

where $$\Delta=\frac{2}{1+\frac{1}{1-\frac{1}{1-\left(\frac{\lambda_c}{\lambda}\right)^2}}}$$

$$\lambda c=2a$$

where bw is the percent 1 dB bandwidth and λc is the guide cutoff wavelength.

Capacitors 10*b*, 11*b* are chosen such that $$C_{shunt}=\frac{1}{\frac{L_{shunt}}{2}\omega_o^2}$$

where $L_{shunt}$ is the shunt inductance of the section of waveguide bandpass filter 100 as given by the formula above, and $\omega_o$ is the desired frequency of waveguide bandpass filter 100.

The unloaded Q of a length of waveguide bandpass filter 100 is calculated as $$Q_u=\frac{\omega\mu}{R_s}\frac{ab}{2}\frac{1-\frac{1}{2}\left(\frac{f}{f_c}\right)^2}{a\left[1-\frac{1}{2}\left(\frac{f}{f_c}\right)^2\right]+b}+\frac{1}{\tan\delta}$$

where $R_s=\sqrt{\frac{\omega\mu}{2\sigma}}$ and where $\tan\delta$ = loss tangent of the dielectric filler material ω is the radial frequency and σ is the conductivity of the particular waveguide conductor (typically copper). As those of ordinary skill in the art of dielectrics know, at higher frequencies an increase in dielectric losses generally causes the insertion loss of a filter to increase. Each inductor in the pi or tee model must then be modified to account for these losses by inserting a resistor in series with each inductor. The value of the resistor needed to account for the loss of a particular inductor L is $$R = \frac{\omega L}{Q_u}$$

Similarly, each capacitor must be modified to account for its finite Q by inserting a resistor in parallel with each capacitor. The value of the resistor needed to account for the loss of a particular capacitor C (i.e., capacitor 10*b* or capacitor 11*b*) is $$R = \frac{Q_{res}}{\omega C}$$

where $$Q_{res} = \frac{1}{\tan\delta}$$

and is the loss tangent of the capacitor dielectric.

Feed posts 1, 2 and resonator via holes 10*a*, 11*a* may also be modeled as lumped inductors, as shown in FIGS. 1*a* and 1*b*. The inductance of a via hole may be modeled as a round wire inductance. Values may be obtained from tables found in Grover, F. W., *Inductance Calculations*, Van Nostrand, Princeton, 1946.

The diameter of feed posts 1, 2 and resonator via holes 10*a*, 11*a* are designed to be approximately a/5. The capacitor material selection, the waveguide filler dielectric constant $\in_r$ and the cross sectional dimensions of waveguide bandpass filter 100 are chosen to achieve a favorable unloaded Q (as given by the formulas above) at the desired frequency and also to obtain the desired stopband performance, such as the rejection level and the rejection bandwith for waveguide bandpass filter 100.

The distance between the center of feed post 1 and conductive wall 3*b* (the length of section 4), the distance between the center of feed post 2 and conductive wall 9*b* (the length of section 8), the distance between the center of feed post 1 and the center of resonator via hole 10*a* (the length of section 5), and the distance between the center of resonator via hole 11*a* and the center of feed post 2 (the length of section 7) are initially chosen empirically and then optimized to improve performance. For example, as a starting point sections 5, 6, 7 are chosen to be the same length, while section 4, 8 are chosen to be a/2.

These lengths, as well as the values for L and C are further optimized using an optimization routine. An optimizer, such as one included in the linear circuit simulator Touchstone by HPEESOF, using an error minimization procedure, can realize improved performance by taking into account physical constraints, realizability, and the parameters of the elements involved.

Once favorable results are obtained using the above steps, a physical model is designed and simulated using a full-wave 3-dimensional field solver such as MicroStripes by Sonnet Software.

Capacitors 10*b*, 11*b* are of the parallel-plate type in a preferred embodiment and are fabricated from ceramics, preferably having low-loss tangent values, and having dielectric constant values from approximately 30 to approximately 80, although other dielectric constants, such as approximately 1 to approximately 500, are possible when commercially available. The dimensions of capacitors 10*b*, 11*b* are calculated from the formula C=∈* (surface area)/(ceramic thickness), where ∈ is the permittivity of the ceramic medium. In a preferred embodiment, capacitors 10*b*, 11*b* are dielectric pucks that are electroplated on both sides before bonding one side to bottom conducting wall 114. In an alternative preferred embodiment, for higher frequencies the amount of loading capacitance required is small, hence a smaller capacitor may be used or air may be used instead of a ceramic. In an alternative embodiment, capacitors 10*b*, 11*b* are multilayer or are active, such as varactor type or FET-type or MEMS technology.

Manufacturing the Invention

The following is a step-by-step description of the process used to build a preferred embodiment of the invention having a fractional bandwidth of 0.3%. The dimensions of this preferred embodiment may be modified, by way of example only, to provide the performance curves illustrated in FIGS. 3*a*, 3*b*, 3*c*, 3*d*. However, the performance curves for this particular embodiment are illustrated in FIGS. 4*a*, 4*b*, 4*c*, 4*d*.

In a preferred embodiment, waveguide bandpass filter 100 is constructed from a stack of nine substrate layers, such as R03010 material available from Rogers Corporation in Rogers, Conn., having dielectric constants of approximately 10.2, bonded to form a multilayer structure manufactured by following the steps outlined below. Each layer is approximately 1.014 inches long and approximately 0.240 inches wide. It is to be appreciated that typically hundreds of circuits are manufactured at one time in an array on a substrate panel. Thus, a typical mask may have an array of the same pattern. Adequate spacing, preferably at least approximately ¼ inch, be provided between elements of the array.

Subassembly 500

Figure 5C:
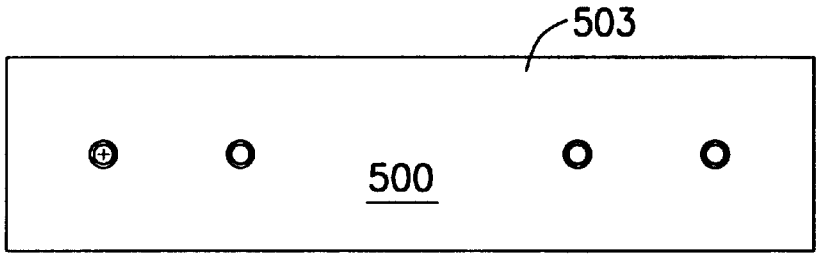
FIG. 5*c* is a bottom view of the unfinished bonded first, second, and third layers of a nine-layered evanescent mode waveguide filter having a functional bandwidth of 0.3%.
Figure 5B:
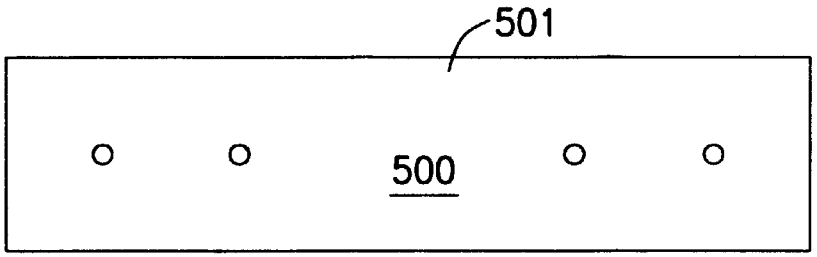
FIG. 5*b* is a top view of the unfinished bonded first, second, and third layers of a nine-layered evanescent mode waveguide filter having a functional bandwidth of 0.3%.
Figure 5A:
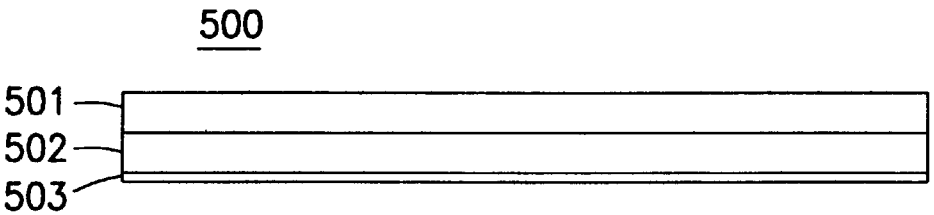
FIG. 5*a* is a side view of the unfinished bonded first, second, and third layers of a nine-layered evanescent mode waveguide filter having a functional bandwidth of 0.3%.

With reference to FIG. 5*a*, layers 501, 502, copper clad 0.05 inch thick 50 Ohm dielectrics and layer 503, a copper clad 0.01 inch thick 50 Ohm dielectric, are fusion bonded to form subassembly 500 using a profile of 200 PSI, with a 40 minute ramp from room temperature to 240 degrees C., a 45 minute ramp to 375 degrees C., a 15 minute dwell at 375 degrees C., and a 90 minute ramp to room temperature. Next, four holes having diameters of approximately 0.024 inches are drilled into subassembly 500 as shown in FIGS. 5*b* and 5*c*. Subassembly 500 is sodium etched. Next, subassembly 500 is cleaned by rinsing in alcohol for 15 minutes, then rinsing in deionized water having a temperature of 70 degrees F. for 15 minutes. Subassembly 500 is then vacuum baked for one hour at 149 degrees C. Subassembly 500 is plated with copper, first using an electroless method to form a copper seed layer followed by an electrolytic method to provide a copper plate, to a thickness of 0.0005 to 0.001 inches. Subassembly 500 is rinsed in deionized water for at least one minute. Subassembly 500 is heated to 90 degrees C. for 5 minutes and then laminated with photoresist. A mask is used and the photoresist is developed using the proper exposure settings to create the pattern shown in FIG. 5*c*. The bottom side of subassembly 500 is copper etched. Subassembly 500 is cleaned by rinsing in alcohol for 15 minutes, then rinsing in deionized water having a temperature of 70 degrees F. for 15 minutes. Subassembly 500 is vacuum baked again for one hour at 149 degrees C.

Subassembly 600

Figure 6C:
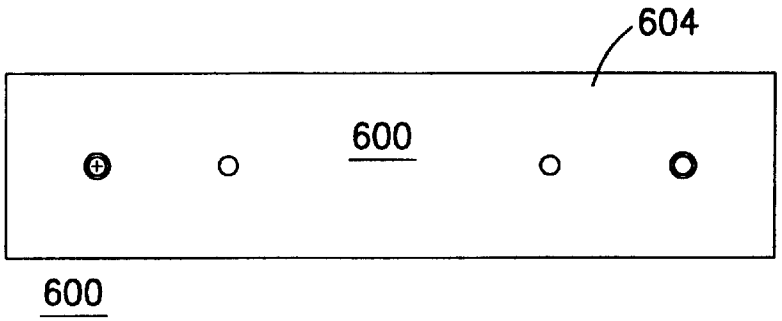
FIG. 6*c* is a bottom view of the unfinished bonded fourth, fifth, sixth, and seventh layers of a nine-layered evanescent mode waveguide filter having a functional bandwidth of 0.3%.
Figure 6B:
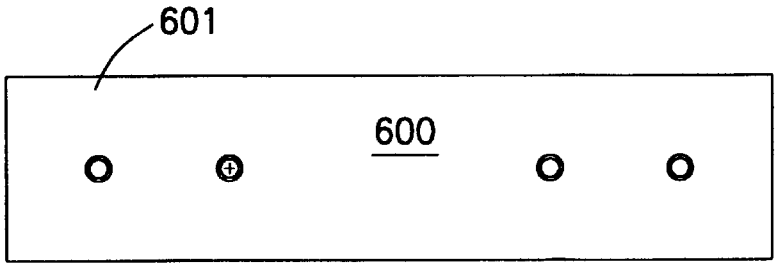
FIG. 6*b* is a top view of the unfinished bonded fourth, fifth, sixth, and seventh layers of a nine-layered evanescent mode waveguide filter having a functional bandwidth of 0.3%.
Figure 6A:
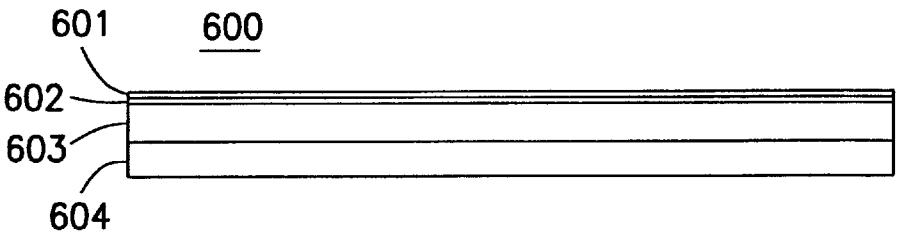
FIG. 6*a* is a side view of the unfinished bonded fourth, fifth, sixth, and seventh layers of a nine-layered evanescent mode waveguide filter having a functional bandwidth of 0.3%.

With reference to FIG. 6*a*, layers 601, 602, copper clad 0.01 inch thick 50 Ohm dielectrics, and layers 603, 604, copper clad 0.05 inch thick 50 Ohm dielectrics, are fusion bonded to form subassembly 600 using a profile of 200 PSI, with a 40 minute ramp from room temperature to 240 degrees C., a 45 minute ramp to 375 degrees C., a 15 minute dwell at 375 degrees C., and a 90 minute ramp to room temperature. Next, four holes having diameters of approximately 0.024 inches are drilled into subassembly 600 as shown in FIGS. 6*b* and 6*c*. Subassembly 600 is sodium etched. Next, subassembly 600 is cleaned by rinsing in alcohol for 15 minutes, then rinsing in deionized water having a temperature of 70 degrees F. for 15 minutes. Subassembly 600 is then vacuum baked for one hour at 149 degrees C. Subassembly 600 is plated with copper, first using an electroless method followed by an electrolytic method, to a thickness of 0.0005 to 0.001 inches. Subassembly 600 is rinsed in deionized water for at least one minute. Subassembly 600 is heated to 90 degrees C. for 5 minutes and then laminated with photoresist. A mask is used and the photoresist is developed using the proper exposure settings to create the patterns shown in FIGS. 6*b* and 6*c*. The top side and bottom side of subassembly 600 are copper etched. Subassembly 600 is cleaned by rinsing in alcohol for 15 minutes, then rinsing in deionized water having a temperature of 70 degrees F. for 15 minutes. Subassembly 600 is vacuum baked again for one hour at 149 degrees C.

Layer 700

Figure 7C:
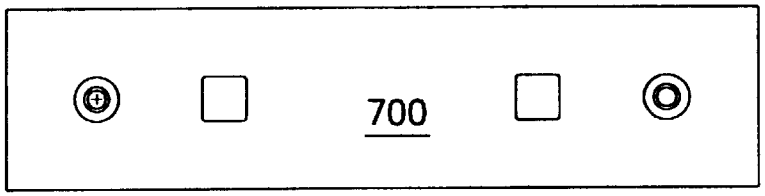
FIG. 7*c* is a bottom view of the unfinished eighth layer of a nine-layered evanescent mode waveguide filter having a functional bandwidth of 0.3%.
Figure 7B:
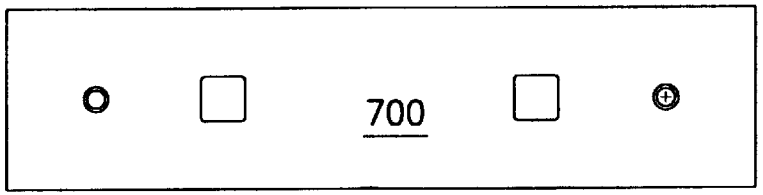
FIG. 7*b* is a top view of the unfinished eighth layer of a nine-layered evanescent mode waveguide filter having a functional bandwidth of 0.3%.
Figure 7A:
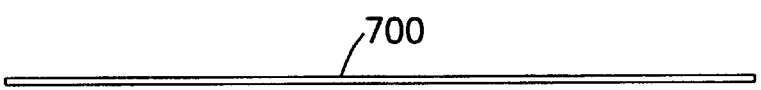
FIG. 7*a* is a side view of the unfinished eighth layer of a nine-layered evanescent mode waveguide filter having a functional bandwidth of 0.3%.

With reference to FIGS. 7*a*, 7*b*, 7*c*, two holes having diameters of approximately 0.024 inches are drilled into layer 700, which is a copper clad 0.01 inch thick 50 Ohm dielectric, as shown in FIGS. 7*b* and 7*c*. Layer 700 is sodium etched. Next, layer 700 is cleaned by rinsing in alcohol for 15 minutes, then rinsing in deionized water having a temperature of 70 degrees F. for 15 minutes. Layer 700 is then vacuum baked for one hour at 149 degrees C. Layer 700 is plated with copper, first using an electroless method followed by an electrolytic method, to a thickness of 0.0005 to 0.001 inches. Layer 700 is rinsed in deionized water for at least one minute. Two slots having the dimensions of 0.060 inches by 0.060 inches are milled as shown in FIGS. 7*b* and 7*c*. Layer 700 is heated to 90 degrees C. for 5 minutes and then laminated with photoresist. A mask is used and the photoresist is developed using the proper exposure settings to create the patterns shown in FIGS. 7*b* and 7*c*. The top side and bottom side of layer 700 is copper etched. Layer 700 is cleaned by rinsing in alcohol for 15 minutes, then rinsing in deionized water having a temperature of 70 degrees F. for 15 minutes. Layer 700 is vacuum baked again for one hour at 149 degrees C.

Plates 800

Figure 8B:
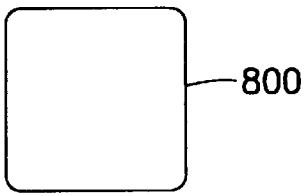
FIG. 8*b* is a top view of ceramic plate for a nine-layered evanescent mode waveguide filter having a functional bandwidth of 0.3%.
Figure 8A:
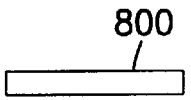
FIG. 8*a* is a side view of a ceramic plate for a nine-layered evanescent mode waveguide filter having a functional bandwidth of 0.3%.

With reference to FIGS. 8*a*, 8*b*, plates 800, which consists of two ceramic substrates having a dielectric constant of approximately 80 and dimensions of 0.060 inches long, 0.060 inches wide, and 0.010 inches thick, are sodium etched (two views of one plate 800 are shown in FIG. 8*a*, 8*b*). Next, plates 800 are cleaned by rinsing in alcohol for 15 minutes, then rinsing in deionized water having a temperature of 70 degrees F. for 15 minutes. Plates 800 are then vacuum baked for one hour at 149 degrees C. Plates 800 are plated with copper, first using an electroless method followed by an electrolytic method, to a thickness of 0.0005 to 0.001 inches. Plates 800 are rinsed in deionized water for at least one minute. Plates 800 are de-paneled using a depaneling method, which may include drilling and milling, diamond saw, and/or EXCIMER laser. Plates 800 are cleaned by rinsing in alcohol for 15 minutes, then rinsing in deionized water having a temperature of 70 degrees F. for 15 minutes. Plates 800 are vacuum baked again for one hour at 100 degrees C.

Layer 900

Figure 9C:
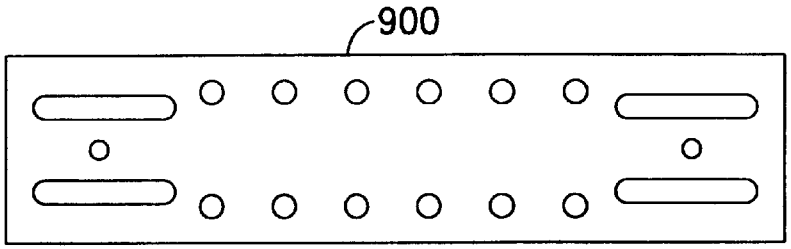
FIG. 9*c* is a bottom view of the unfinished ninth layer of a nine-layered evanescent mode waveguide filter having a functional bandwidth of 0.3%.
Figure 9B:
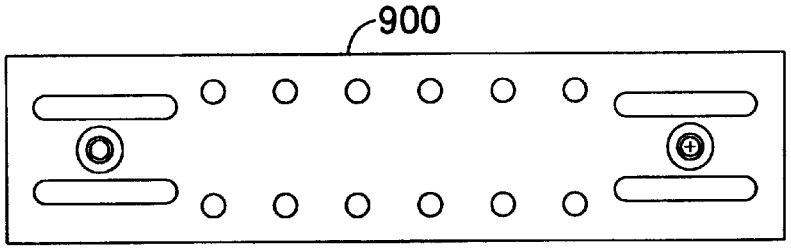
FIG. 9*b* is a top view of the unfinished ninth layer of a nine-layered evanescent mode waveguide filter having a functional bandwidth of 0.3%.
Figure 9A:
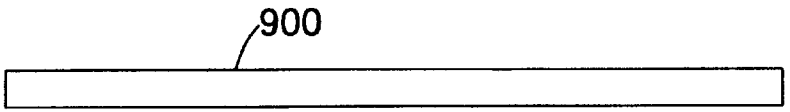
FIG. 9*a* is a side view of the unfinished ninth layer of a nine-layered evanescent mode waveguide filter having a functional bandwidth of 0.3%.

With reference to FIGS. 9*a*, 9*b*, 9*c*, two holes having diameters of approximately 0.024 inches and 12 holes having diameters of approximately 0.031 inches are drilled into layer 900, which is a copper clad 0.050 inch thick 50 Ohm dielectric, as shown in FIGS. 9*b* and 9*c*. Four slots having approximate dimensions of 0.192 inches by 0.031 inches are milled as shown in FIGS. 9*b* and 9*c*. Layer 900 is sodium etched. Next, layer 900 is cleaned by rinsing in alcohol for 15 minutes, then rinsing in deionized water having a temperature of 70 degrees F. for 15 minutes. Layer 900 is then vacuum baked for one hour at 149 degrees C. Layer 900 is plated with copper, first using an electroless method followed by an electrolytic method, to a thickness of 0.0005 to 0.001 inches. Layer 900 is rinsed in deionized water for at least one minute. Layer 900 is heated to 90 degrees C. for 5 minutes and then laminated with photoresist. A mask is used and the photoresist is developed using the proper exposure settings to create the pattern shown in FIG. 9*b*. The top side of layer 900 is copper etched. Layer 900 is cleaned by rinsing in alcohol for 15 minutes, then rinsing in deionized water having a temperature of 70 degrees F. for 15 minutes. Layer 900 is vacuum baked again for one hour at 149 degrees C.

Assembly 1000

Figure 10C:
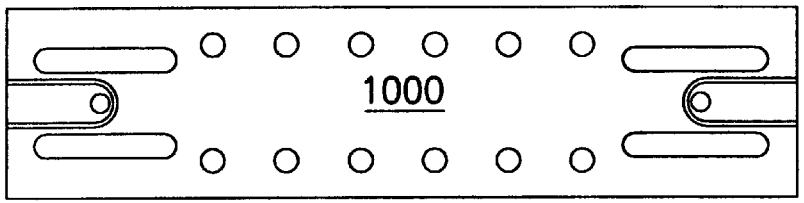
FIG. 10*c* is a bottom view of the finished assembly of a nine-layered evanescent mode waveguide filter having a functional bandwidth of 0.3%.
Figure 10B:
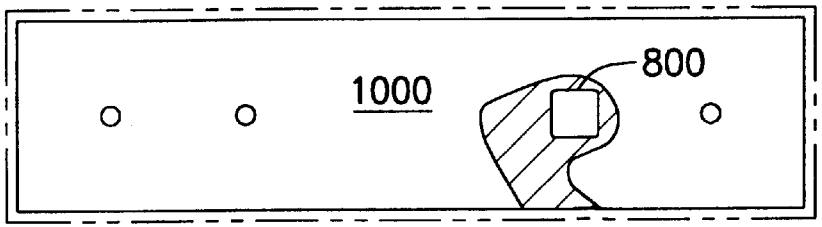
FIG. 10*b* is a top view of the finished assembly of a nine-layered evanescent mode waveguide filter having a functional bandwidth of 0.3%, with a cutout showing the placement of one of the plates from FIG. 8.
Figure 10A:
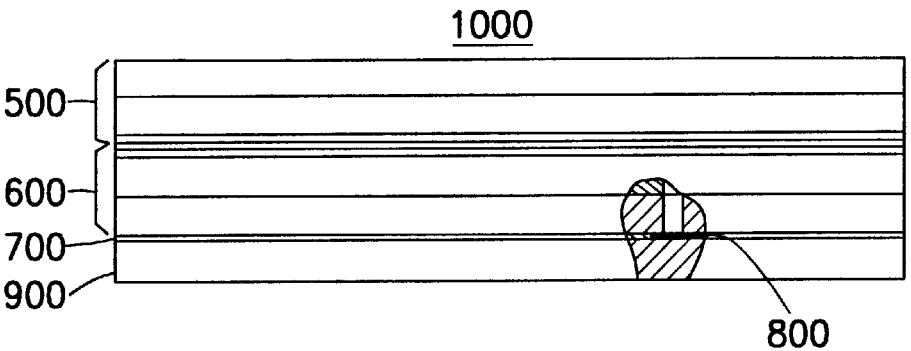
FIG. 10*a* is a side view of the finished assembly of a nine-layered evanescent mode waveguide filter having a functional bandwidth of 0.3%, with a cutout showing the placement of one of the plates from FIG. 8.

With reference to FIGS. 10*a*, 10*b*, 10*c*, subassembly 500, subassembly 600, layer 700, plates 800 (placement for one plate 800 is shown in the visual cutouts of FIGS. 10*a* and 10*b*, the other plate 800 is symmetrically placed), and layer 900 are fusion bonded to form assembly 1000 using a profile of 200 PSI, with a 40 minute ramp from room temperature to 240 degrees C., a 45 minute ramp to 375 degrees C., a 15 minute dwell at 375 degrees C., and a 90 minute ramp to room temperature. Next, assembly 1000 is milled along the edges to a depth of approximately 0.25 inches deep, as shown in FIG. 10*b*. Assembly 1000 is sodium etched. Next, assembly 1000 is cleaned by rinsing in alcohol for 15 minutes, then rinsing in deionized water having a temperature of 70 degrees F. for 15 minutes. Assembly 1000 is then vacuum baked for one hour at 149 degrees C. Assembly 1000 is plated with copper, first using an electroless method followed by an electrolytic method, to a thickness of 0.0005 to 0.001 inches. In this process, care is taken that a ring around the edge of layer 900 is left unplated, so that the top of assembly 1000 and the bottom of assembly 1000 are not short-circuited. Assembly 1000 is rinsed in deionized water for at least one minute. Assembly 1000 is heated to 90 degrees C. for 5 minutes and then laminated with photoresist. A mask is used and the photoresist is developed using the proper exposure settings to create the pattern shown in FIG. 10*c*. The bottom side of assembly 1000 is copper etched. Assembly 1000 is cleaned by rinsing in alcohol for 15 minutes, then rinsing in deionized water having a temperature of 70 degrees F. for 15 minutes. Assembly 1000 is plated with tin, then the tin plating is heated to the melting point to allow excess plating to reflow. In this plating process, care is taken that while subassembly 500, subassembly 600, and layer 700 are covered with plating, layer 900 is not plated near the bottom. Assembly 1000 is de-paneled. Assembly 1000 is cleaned again by rinsing in alcohol for 15 minutes, then rinsing in deionized water having a temperature of 70 degrees F. for 15 minutes. Assembly 1000 is vacuum baked again for one hour at 100 degrees C., resulting in a physical embodiment of waveguide bandpass filter 100.

It is to be appreciated by those of ordinary skill in the art of manufacturing multilayered polytetrafluoroethylene ceramics/glass (PTFE composite) circuitry that the numbers used above (by way of example only, dimensions, temperatures, time) are approximations and may be varied, and that certain steps may be performed in different order.

In an alternative preferred embodiment, waveguide bandpass filter 100 is manufactured using other multilayer technologies, such as low-temperature cofired ceramic (LTCC).

In another alternative preferred embodiment, waveguide bandpass filter 100 is manufactured with an injection molding process. A panel may contain a number of cavities inside the mold. Material is injected within the mold to form the body of waveguide bandpass filter 100. Electroplating of the body or other means is used to form conductive walls 3*b*, 9*b*, 112, 114.

Performance of the Invention

In preferred embodiments of the invention, the center frequency may range from UHF through millimeter frequencies. A passband insertion loss of from approximately 0.1 dB through approximately 10 dB is achievable. A VSWR (voltage standing wave ratio) of less than 2:1 is also achievable. Larger implementations of the invention may filter signals that are hundreds of watts. A bandwidth having less than 1 dB drop in output from the maximum value may be achieved from the range of approximately 0.1% through multi-octave. By way of example, the present invention may be used to filter a 1 GHz signal wherein a drop in output of less than 1 dB from the maximum value is achieved for frequencies between 0.999 GHz and 1.001 GHz. Finally, implementations of the invention were tested to operate at temperatures ranging from approximately −55 degrees C. to +125 degrees C. with minimal performance degredation, but are operable for broader ranges of temperature. Based upon the above description of the operation of the invention and physical construction of the invention, the design and construction of the various embodiments described herein would be obvious to one skilled in the art of designing and constructing waveguide bandpass filters.

Referring to FIGS. 3*a*, 3*b*, 3*c*, 3*d*, performance curves for a preferred embodiment of the invention having a fractional bandwidth of 0.9% are illustrated. This particular embodiment has the following realized dimensions: the overall dimensions are 0.24 inches by 0.24 inches by 0.808 inches, the lengths of sections 4, 8 are 0.125 inches each, the lengths of sections 5, 7 are 0.113 each, and the length of section 6 is 0.332 inches.

Chart 310 shows return loss 312 and transmission 314, in decibels, versus frequency for frequencies from 0.7 GHz to 1.3 GHz. Chart 320 shows transmission 322, in decibels, versus frequency for frequencies from 0.99 GHz to 1.01 GHz. Chart 330 shows normalized magnitude 332 in dBc (decibels normalized to the carrier frequency) versus frequency for frequencies from 0 GHz to 4 GHz. Chart 340 shows group delay 342 in nanoseconds versus frequency for frequencies from 0.95 GHz to 1.05 GHz.

Referring to FIGS. 4*a*, 4*b*, 4*c*, 4*d*, performance curves for a preferred embodiment of the invention, manufactured by the process described above for assembly 1000 and having a fractional bandwidth of 0.3% are illustrated. This particular embodiment has the following realized dimensions: the overall dimensions are 0.24 inches by 0.24 inches by 1.014 inches, the lengths of sections 4, 8 are 0.125 inches each, the lengths of sections 5, 7 are 0.172 each, and the length of section 6 is 0.420 inches.

Chart 410 shows return loss 412 and transmission 414, in decibels, versus frequency for frequencies from 0.7 GHz to 1.3 GHz. Chart 420 shows transmission 422, in decibels, versus frequency for frequencies from 0.995 GHz to 1.005 GHz. Chart 430 shows normalized magnitude 432 in dBc versus frequency for frequencies from 0 GHz to 4 GHz. Chart 440 shows group delay 442 in nanoseconds versus frequency for frequencies from 0.99 GHz to 1.01 GHz.

Direct Feed Resonator Via Holes

Figure 13A:
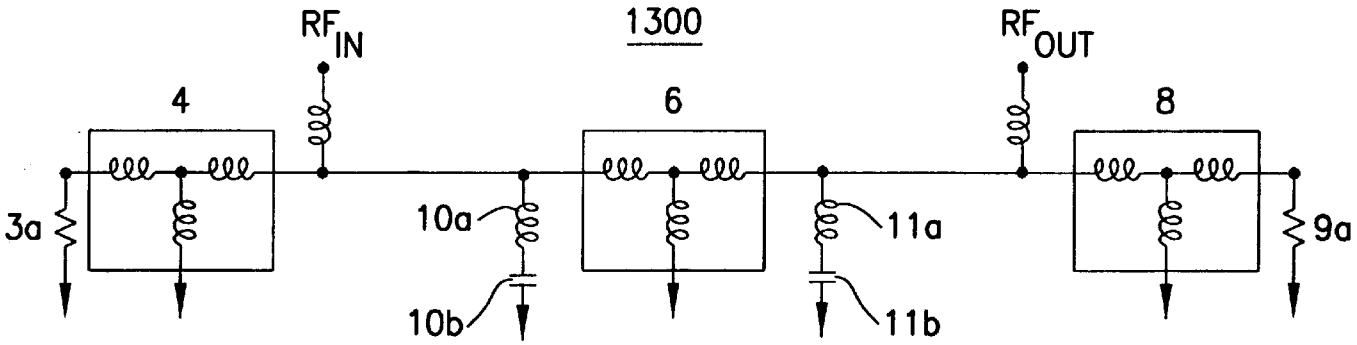
FIG. 13*a* is a schematic diagram of an alternative preferred embodiment of an evanescent mode waveguide filter wherein sections of the filter are modeled using tee networks of inductors.
Figure 13B:
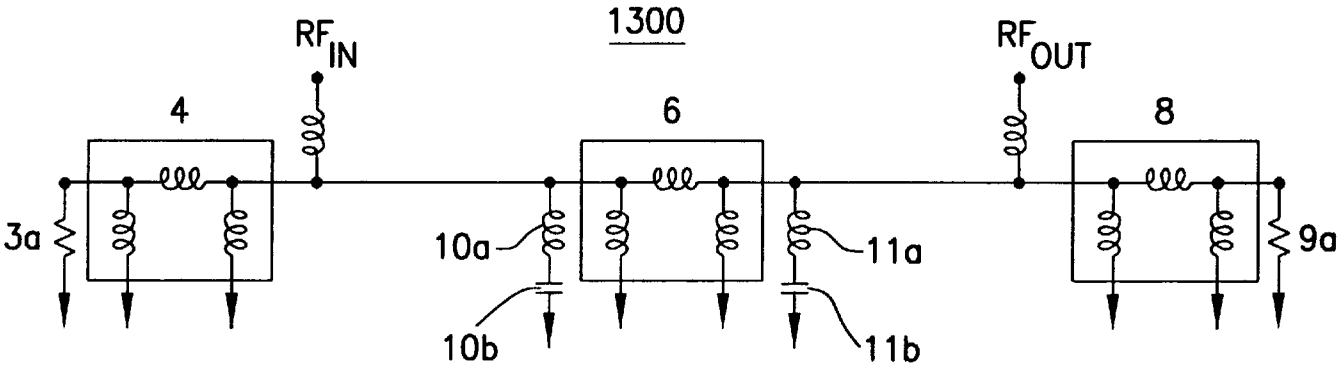
FIG. 13*b* is a schematic diagram of the evanescent mode waveguide filter shown in FIG. 13*a* wherein sections of the filter are modeled using pi networks of inductors.
Figure 14:
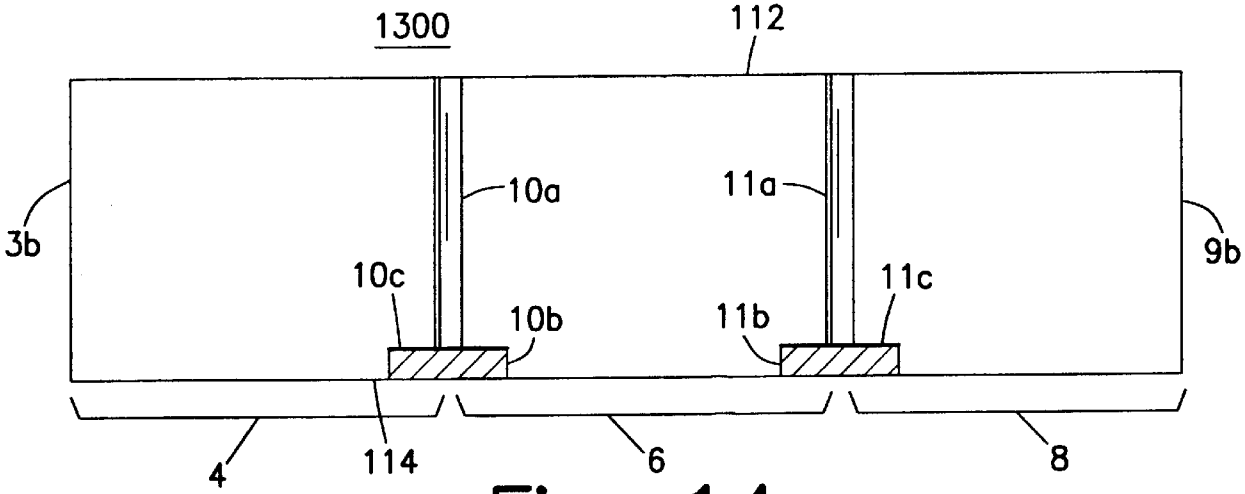
FIG. 14 is an assembly diagram of the evanescent mode waveguide filter shown in FIG. 13*a* and FIG. 13*b*.

In an alternative embodiment, resonator via holes may be used as feed posts, thereby eliminating the need for additional via holes acting solely as feed posts. Referring to FIGS. 13*a* and 13*b*, schematic diagrams of a preferred embodiment of a second order evanescent mode waveguide bandpass filter 1300, not taking dielectric losses into account, is shown. FIGS. 13*a* and 13*b* are different representations of the same evanescent mode waveguide bandpass filter 1300, and it is obvious to those of ordinary skill in the art of analog circuit design that the tee networks of inductors representing waveguide sections 4, 6, 8 may be easily transformed into pi networks of inductors. An assembly diagram of filter 1300 is shown in FIG. 14. In a preferred embodiment, a signal is inductively fed from an input TEM transmission line to resonator via hole 10*a*, thereby exciting the dominant $TE_{10}$ evanescent mode of waveguide bandpass filter 1300. Waveguide sections 4, 6, 8 of waveguide bandpass filter 1300 form inductive tee or pi sections and constitute filter elements. In a preferred embodiment, wherein waveguide bandpass filter 1300 is short-circuited, resistances 3*a*, 9*a* model the sheet resistivity of end conductive walls 3*b*, 9*b* (in an alternative preferred embodiment an open-ended waveguide does not have end shielding). Resonator via holes 10*a*, 11*a* are inserted in waveguide bandpass filter 1300 such that capacitors 10*b*, 11*b* form resonances with inductive section 6 to achieve the desired shape factor. The desired shape factor is dependent upon the desired filter performance characteristics, and is typically defined as the ratio of the 60 dB bandwidth to the 6 dB bandwidth. Resonator via hole 11*a* transfers the signal to an output TEM transmission line.

Waveguide Filter Perimeter Defined By Via Holes or Slots

Figure 15:
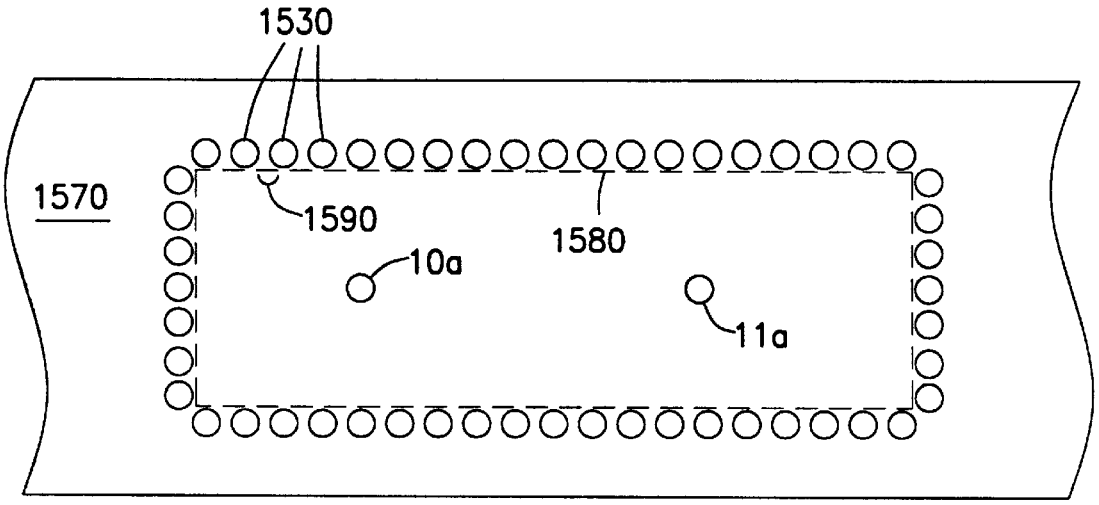
FIG. 15 is a cross-sectional view of an evanescent mode waveguide filter that utilizes grounded via holes to define a perimeter.

In another alternative embodiment, the perimeter of the waveguide filter is defined by via holes. Referring to FIG. 15, an evanescent mode waveguide filter embodying the schematic diagrams of FIG. 13*a* and 13*b* is shown. Via holes 1530, which are disposed in dielectric material 1570, form a desired waveguide perimeter 1580 illustrated by a broken line. Via holes 1530 are placed tangent to waveguide perimeter 1580, and have arbitrary diameters but in a preferred embodiment have diameters of 0.024 inches. Via holes 1530 are grounded, preferably by connecting them to conductive wall 112 and conductive wall 114 (not shown in FIG. 15). The spacing 1590 between the edges of two neighboring via holes may be from approximately zero to approximately $\lambda/8$, wherein λ is the wavelength of the propagating signal in the dielectric material and is given by the formula $$\lambda = \frac{\lambda_o}{\sqrt{\epsilon_r}}$$

In a preferred embodiment, spacing 1590 is approximately λ/16.

Figure 16:
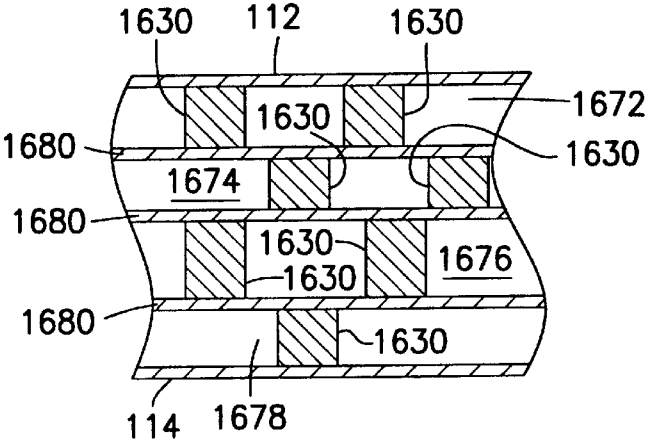
FIG. 16 is a side view of an evanescent mode waveguide filter that utilizes a lattice of grounded via holes to define a perimeter.
Figure 17A:
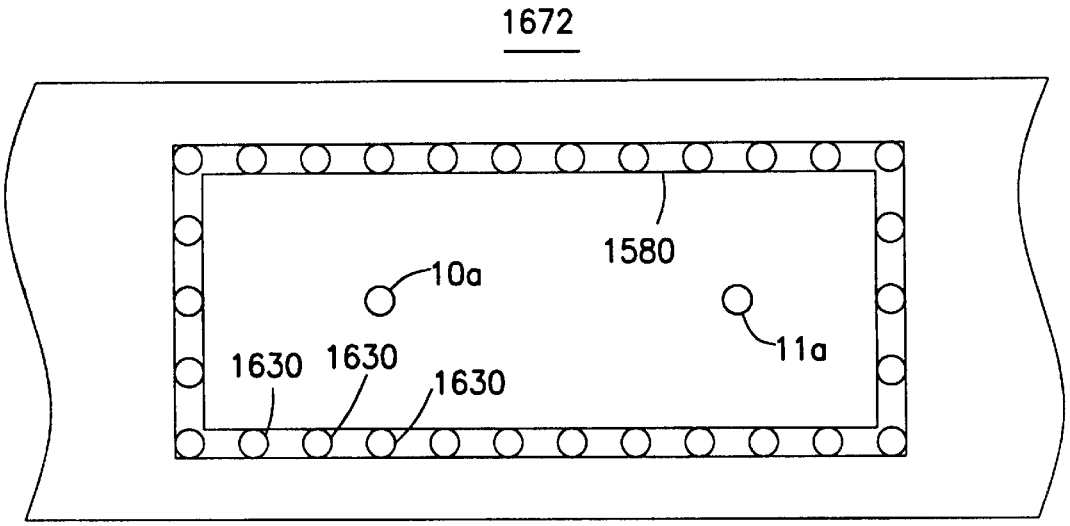
FIG. 17*a* is a top view of an intermediate layer of the evanescent mode waveguide filter shown in FIG. 16.
Figure 17B:
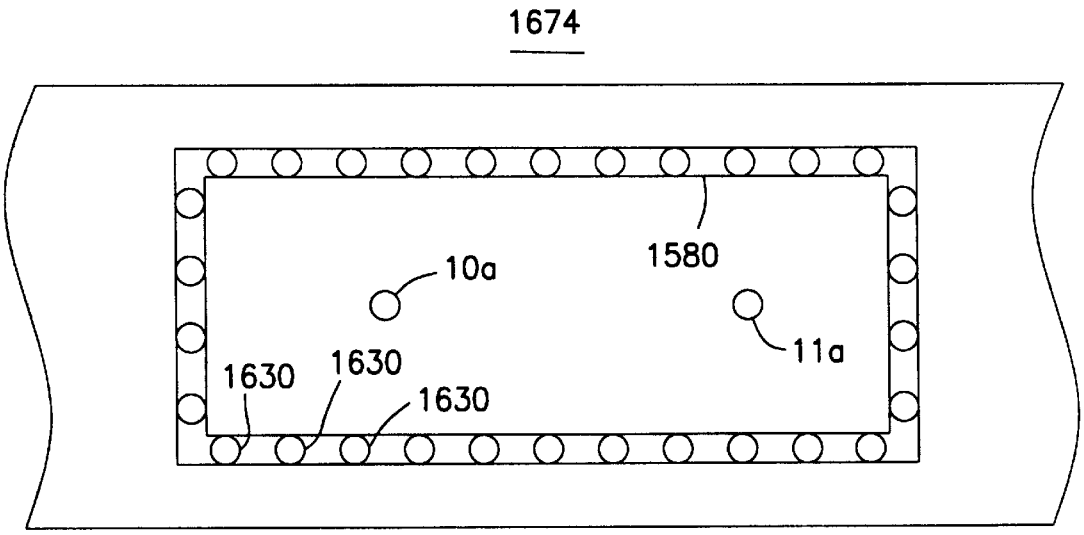
FIG. 17*b* is a top view of an intermediate layer of the evanescent mode waveguide filter shown in FIG. 16 that is adjacent to the intermediate layer shown in FIG. 17*a*.

The via holes defining the perimeter of a waveguide filter may also be placed in the form of a lattice. A lattice of via holes, or slots in an alternative preferred embodiment, may be placed on a plurality of substrate layers, as demonstrated by a preferred embodiment with four substrate layers in FIG. 16. In this preferred embodiment, metalization is used to connect via holes or slots 1680 on substrate layers 1672, 1674, 1676, 1678. A top view of substrate layer 1672 is shown in FIG. 17*a*, and a top view of substrate layer 1674 is shown in FIG. 17*b*. Printed strips or interconnecting via pads may be used in conjunction with via holes or slots 1680.

Figure 18:
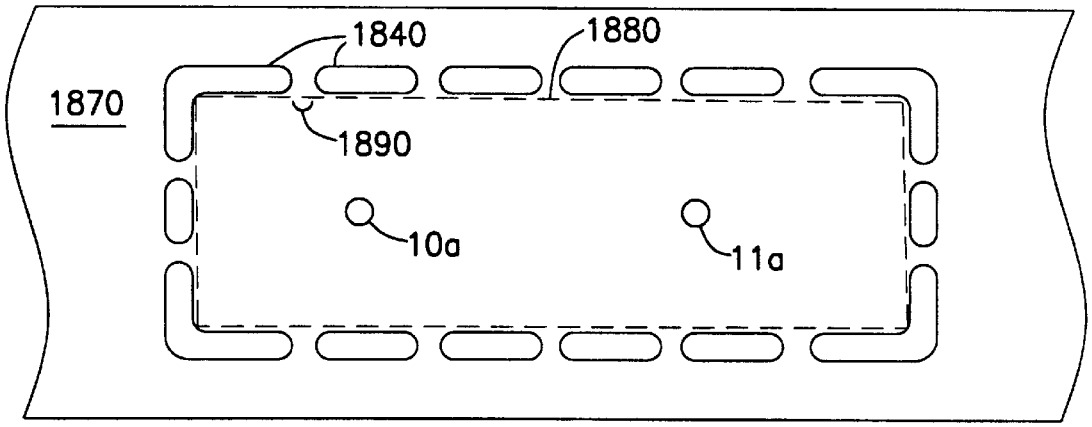
FIG. 18 is a cross-sectional view of an evanescent mode waveguide filter that utilizes grounded slots to define a perimeter.

In another alternative embodiment, the perimeter of the waveguide filter is defined by plated slots. Referring to FIG. 18, an evanescent mode waveguide filter embodying the schematic diagrams of FIG. 13*a* and 13*b* is shown. Plated slots 1840, which are disposed in dielectric material 1870, form a desired waveguide perimeter 1880 illustrated by a broken line. Plated slots 1840 are placed tangent to waveguide perimeter 1880, and have arbitrary thickness and length but in a preferred embodiment have a thickness of 0.024 inches and a length of 0.100 inches. Plated slots 1840 are grounded, preferably by connecting them to conductive wall 112 and conductive wall 114 (not shown in FIG. 18). The spacing 1890 between the edges of two neighboring plated slots may be from approximately zero to approximately λ/8, wherein λ is the wavelength of the propagating signal in the dielectric material and is given by the formula $$\lambda = \frac{\lambda_o}{\sqrt{\epsilon_r}}$$

In a preferred embodiment, spacing 1890 is approximately λ/16.

It should be noted that in a preferred embodiment described above, assembly 1000 is de-paneled, resulting in a discrete waveguide filter that must subsequently be physically attached to other circuits. The advantage of a waveguide filter having a perimeter defined by via holes or plated slots is that it may be combined with other components on the same substrate in a manner that is obvious to those of ordinary skill in the art of designing multilayered microwave circuits.

Other Embodiments

Figure 11B:
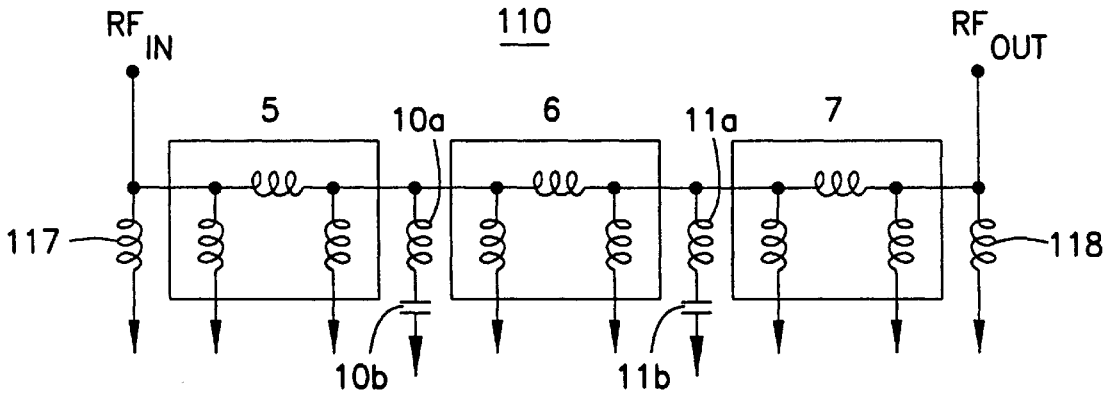
FIG. 11*b* is a schematic diagram of the open evanescent mode waveguide filter shown in FIG. 11*a*.
Figure 12A:
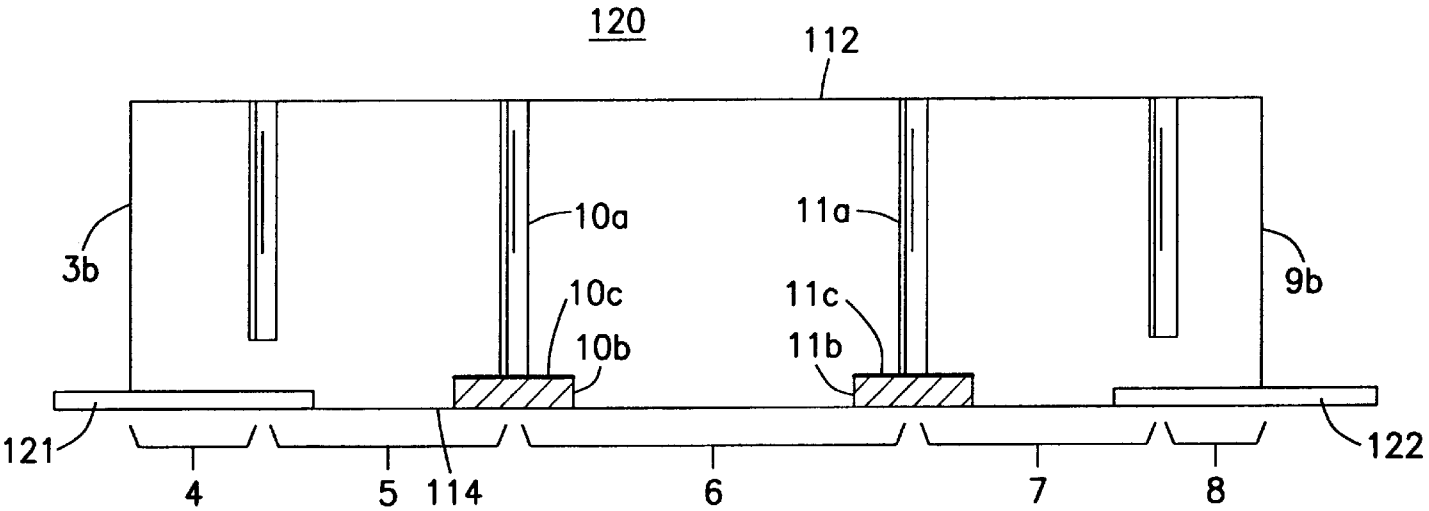
FIG. 12*a* is an assembly diagram of an evanescent mode waveguide filter with internal microstrip power feeds.
Figure 12B:
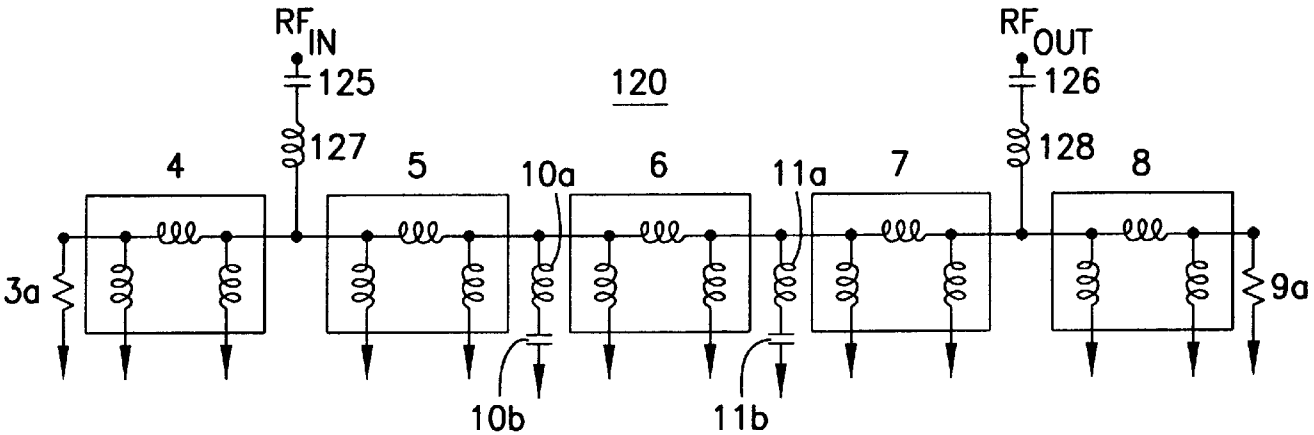
FIG. 12*b* is a schematic diagram of the evanescent mode waveguide filter with internal microstrip power feeds shown in FIG. 12*a*.

It is obvious to those with ordinary skill in the art of evanescent mode waveguide filter design that there are alternative methods of feeding power to an evanescent mode waveguide. For example, feed posts 1, 2, may be of the loop-type as discussed in an alternative preferred embodiment above. It would also be obvious to replace feed post 1 (along with conductive wall 3*b* and waveguide section 4) and/or feed post 2 (along with conductive wall 9*b* and waveguide section 8) with a waveguide operating in its normal mode. For example, referring to FIG. 11*a*, waveguides 115, 116 may be used to transfer power to and from waveguide bandpass filter 110. A schematic diagram of a lossless model of waveguide bandpass filter 110 is shown in FIG. 11*b*, with inductive shunts 117, 118. Alternatively, referring to FIG. 12*a*, microstrips 121, 122 may be used to transfer power to and from waveguide bandpass filter 120. A schematic diagram of a lossless model of waveguide bandpass filter 120 is shown in FIG. 12*b*, with capacitors 125, 126 in series with inductors 127, 128, respectively. It is also obvious to those with ordinary skill in the art of evanescent mode waveguide filter design that the features of waveguide bandpass filters 100, 110, 120 may be mixed, and still operate as bidirectional filters. It is also obvious that any of these filters may be implemented as delay lines. Additionally, it is also obvious that although in a preferred embodiment waveguide bandpass filters 100, 110, 120 have rectangular cross-sections, alternative embodiments include filters having other shapes, such as cylindrical or polygonal by way of example.

It is obvious to those of ordinary skill in the art of multilayered co-fired ceramics that waveguide filters may be implemented using low temperature co-fired ceramics (LTCC). What is known in the present art is that waveguide filters may be constructed using LTCC, as shown in U.S. Pat. No. 5,382,931 to Piloto et al. for "Waveguide Filters Having a Layered Dielectric Structure", incorporated herein by reference. What is not known in the present art is that a resonator may comprise a single via hole.

While there have been shown and described and pointed out fundamental novel features of the invention as applied to embodiments thereof, it will be understood that various omissions and substitutions and changes in the form and details of the invention, as herein disclosed, may be made by those skilled in the art without departing from the spirit of the invention. It is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. An evanescent mode waveguide filter comprising:

a plurality of conductive waveguide walls; and at least two resonators, each one of said resonators comprising a via hole and capacitor having a top electrode and a bottom electrode, wherein said via hole is a feed post and substantially extends from one of said plurality of conductive waveguide walls to said top electrode of said capacitor and said bottom electrode of said capacitor is short-circuited to another of said plurality of conductive waveguide walls.

2. The evanescent mode waveguide filter of claim 1, wherein said filter comprises polytetrafluoroethylene composite substrates bonded into a multilayer structure.

3. The evanescent mode waveguide filter of claim 1, wherein:

said capacitor contains a first dielectric material;

said capacitor is adjacent to a second dielectric material; and said first dielectric material is substantially different from said second dielectric material.

4. The evanescent mode waveguide filter of claim 1, wherein:

said capacitor contains a first dielectric material;

said capacitor is adjacent to a second dielectric material; and said first dielectric material is the same as said second dielectric material.

5. The evanescent mode waveguide filter of claim 1, wherein said evanescent mode waveguide filter has a center frequency from approximately 500 MHz to approximately 60 GHz.

6. The evanescent mode waveguide filter of claim 1, wherein said filter contains a permeable gas.

7. The evanescent mode waveguide filter of claim 1, wherein said filter is manufactured using a molding process.

8. The evanescent mode waveguide filter of claim 7, wherein said molding process is an injection-molding process.

9. An evanescent mode waveguide filter with a perimeter comprising:

a plurality of conductive waveguide walls; and at least one resonator comprising a first via hole and a capacitor having a top electrode and a bottom electrode, wherein said first via hole substantially extends from one of said plurality of conductive waveguide walls to said top electrode of said capacitor and said bottom electrode of said capacitor is short-circuited to another of said plurality of conductive waveguide walls;

wherein said perimeter is defined by additional via holes.

10. An evanescent mode waveguide filter with a perimeter comprising:

a plurality of conductive waveguide walls; and at least one resonator comprising a via hole and a capacitor having a top electrode and a bottom electrode, wherein said via hole substantially extends from one of said plurality of conductive waveguide walls to said top electrode of said capacitor and said bottom electrode of said capacitor is short-circuited to another of said plurality of conductive waveguide walls;

wherein said perimeter is defined by plated slots.

11. An evanescent mode waveguide filter comprising:

conductive wall means for providing a waveguide;

means for resonating comprising via hole means connected to capacitor means; and feed post means comprising said via hole means.

12. The evanescent mode waveguide filter of claim 11, wherein said waveguide comprises polytetrafluoroethylene composite substrates bonded into a multilayer structure.

13. The evanescent mode waveguide filter of claim 11, wherein:

said capacitor means comprises a first dielectric material means having a first dielectric constant;

said capacitor means is adjacent to a second dielectric material means having a second dielectric constant; and said first dielectric constant is substantially different from said second dielectric constant.

14. The evanescent mode waveguide filter of claim 11, wherein:

said capacitor means comprises a first dielectric material means having a first dielectric constant;

said capacitor means is adjacent to a second dielectric material means having a second dielectric constant; and said first dielectric constant is the same as said second dielectric constant.

15. The evanescent mode waveguide filter of claim 11, wherein said evanescent mode waveguide filter has a center frequency from approximately 500 MHz to approximately 60 GHz.

16. The evanescent mode waveguide filter of claim 11, wherein said conductive wall means encloses a permeable gas means.

17. The evanescent mode waveguide filter of claim 11, wherein said filter is manufactured using a molding process.

18. The evanescent mode waveguide filter of claim 17, wherein said molding process is an injection-molding process.

19. An evanescent mode waveguide filter comprising:

first via hole means for providing a waveguide perimeter; and means for resonating comprising a second via hole means connected to capacitor means.

20. An evanescent mode waveguide filter comprising:

plated slot means for providing a waveguide perimeter; and means for resonating comprising via hole means connected to capacitor means.

* * * * *